US005712069A

United States Patent [19]

Baba et al.

[11] Patent Number: 5,712,069

[45] Date of Patent: Jan. 27, 1998

[54] TWO-COMPONENT TYPE DEVELOPER, DEVELOPING METHOD AND IMAGE FORMING METHOD

[75] Inventors: Yoshinobu Baba; Yuzo Tokunaga, both of Yokohama, Japan

[73] Assignee: Canon Kabushiki Kaisha, Tokyo, Japan

[21] Appl. No.: 536,782

[22] Filed: Sep. 29, 1995

[30] Foreign Application Priority Data

Oct. 5, 1994 [JP] Japan ..... 6-241193

[51] Int. Cl.[6] ..... G03G 9/083

[52] U.S. Cl. ..... 430/106.6; 430/122

[58] Field of Search ..... 430/106.6, 108, 430/122

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 5,340,677 | 8/1994 | Baba et al. | 430/106.6 |
| 5,439,771 | 8/1995 | Baba et al. | 430/122 |
| 5,464,720 | 11/1995 | Baba et al. | 430/122 |
| 5,470,687 | 11/1995 | Mayama et al. | 430/137 |
| 5,494,770 | 2/1996 | Baba et al. | 430/122 |
| 5,516,613 | 5/1996 | Asanae et al. | 430/106.6 |

FOREIGN PATENT DOCUMENTS

| | | |
|---|---|---|
| 0573933 | 12/1993 | European Pat. Off. . |
| 0580135 | 1/1994 | European Pat. Off. . |
| 0606100 | 7/1994 | European Pat. Off. . |
| 59-104663 | 6/1984 | Japan . |
| 5- 8424 | 2/1993 | Japan . |

*Primary Examiner*—John Goodrow

*Attorney, Agent, or Firm*—Fitzpatrick, Cella, Harper & Scinto

[57] ABSTRACT

A two-component type developer for developing an electrostatic image is constituted by at least a toner and a magnetic carrier. The toner has a weight-average particle size D4 of 1–10 μm, a number-average particle size D1 and such a particle size distribution that particles having size of at most D½ occupy at most 20% by number and particles having sizes of at least D4×2 occupy at most 10% by volume. The magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/g.

60 Claims, 2 Drawing Sheets

TWO-COMPONENT TYPE DEVELOPER, DEVELOPING METHOD AND IMAGE FORMING METHOD

FIELD OF THE INVENTION AND RELATED ART

The present invention relates to a two-component type developer for developing electrostatic images in electrophotography, electrostatic recording, etc., a developing method and an image forming method.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner is attached onto the latent image to develop the latent image. Subsequently, the resultant toner image is, after being transferred onto a transfer material such as paper, as desired, fixed , e.g., by heating, pressing, or heating and pressing, or with solvent vapor, to obtain a copy or a print.

In the step of developing the latent image, charged toner particles are caused to form a toner image by utilizing an electrostatic function of the electrostatic latent image. In the methods of developing electrostatic latent images by using toners in general, a two-component type developer comprising a toner and a carrier in mixture is suitably used in a full color copier or printer required of high image qualities.

In recent years, accompanying the progresses in computer technology, high definition television technology, etc., there have been desired means for outputting full color images of higher resolution. For this purpose, efforts have been made so as to provide full color images of toner having higher quality and higher resolution comparable with those of silver salt photographic images. In compliance with these demands, various studies have been made from the aspects of process and developer.

Regarding the developer for example, a representative effort may be to use a toner and a carrier having smaller particle sizes. However, the use of a smaller particle size toner provides an increased difficulty in powder handling and increased difficulties in optimization of electrophotographic performances, such as those of transfer and fixing other than development. Accordingly, the improvement in image quality by an improvement in toner alone poses a certain limit.

On the other hand, as an effort for improvement in respect of an electrophotographic process, there may be raised a possibility of accomplishing a higher image quality by densifying a magnetic brush on a developer-carrying member, such as a developing sleeve. The densification of the magnetic brush may be accomplished by effecting a development at a part between magnetic poles in the developing sleeve or use of a smaller strength of magnetic poles in the developing sleeve from a process aspect. These measures may suppress the influence of magnetic brush but may be accompanied with difficulties because of insufficient constraint of the developer, such as scattering and poor conveyance performance. Thus, these cannot be simply adopted. The densification of magnetic brush may also be accomplished by use of magnetic carrier particles having a smaller particle size or a lower magnetic force.

For example, Japanese Laid-Open Patent Application (JP-A) 59-104663 has proposed the use of a magnetic carrier having a small saturation magnetization. If a magnetic carrier having a small saturation magnetization is simply used, the thin-line reproducibility may be improved but, as the constraint of magnetic carrier particles on the developing sleeve is weakened, a so-called "carrier attachment" phenomenon of the magnetic carrier being transferred to a photosensitive drum to cause an image defect is liable to occur.

It is also known that the carrier attachment is also liable to be caused when a magnetic carrier of a small particle size is used. Japanese Patent Publication (JP-B) 5-8424 for example has proposed to use a magnetic carrier and a toner of smaller particle sizes to effect a non-contactive development under a vibrating electric field. The JP-B reference contains a description to the effect that the case of a magnetic carrier having a higher resistivity is effective for improving the carrier attachment in a developing process using a vibrating electric field. The use of such a magnetic carrier having a higher specific resistance has been found insufficient in improving the carrier attachment to provide higher image qualities in some cases, particularly where a carrier core having a low specific resistance is exposed to the surface even in a small proportion. In this method adopting a non-contactive developing scheme, fairly good image densities can be attained to provide images free from the carrier attachment in case where the magnetic carrier is provided with a large magnetization strength at the magnetic pole but the image densities are liable to be lowered significantly when the magnetization strength of the magnetic carrier is decreased.

Generally, a magnetic resin carrier is caused to have a bulk resistivity which is higher than those of the carriers having iron powder core or metal oxide core (of, e.g., ferrite, magnetite). In such a case of using, e.g., a magnetic resin carrier allowed to contain an increased amount of magnetic material by using a magnetic material having different particle diameter ratios, it is possible to provide a higher magnetic constraint force if the internally added magnetic material comprises a magnetic material having a low resistivity. However, the use of such a magnetic carrier has failed in sufficiently improving the carrier attachment in some cases when used in a developing process utilizing an alternating magnetic field.

As described above, various measures have been taken in order to realize higher image qualities while preventing the carrier attachment, it has been still desired to provide a two-component type developer, a developing method and an image forming method having solved the above-mentioned problems.

SUMMARY OF THE INVENTION

Accordingly, a generic object of the present invention is to provide a two-component type developer, a developing method and an image forming method having solved the above-mentioned problems.

A more specific object of the present invention is to provide a two-component type developer capable of obviating the carrier attachment and preventing or suppressing the occurrence of fog to provide high-quality toner images, and a developing method and an image forming method using such a two-component type developer.

Another object of the present invention is to provide a two-component type developer capable of forming color toner images of high image density and high clarity, and a developing method and an image forming method using such a two-component type developer.

Another object of the present invention is to provide a two-component type developer having excellent continuous image forming characteristics for a large number of sheets.

A further object of the present invention is to provide a two-component type developer free from image quality degradation even in image formation on a large number of sheets.

A still further object of the present invention is to provide an image forming method capable of providing full color images of high resolution and high image quality.

Still another object of the present invention is to provide an image forming method capable of providing full color images having a good halftone color.

According to the present invention, there is provided a two-component type developer for developing an electrostatic image, comprising: at least a toner and a magnetic carrier; wherein the toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/g.

According to another aspect of the present invention there is provided a developing method for developing an electrostatic image, comprising:

(A) carrying the above-mentioned two-component type developer by a developer-carrying member enclosing therein a magnetic field generating means, (B) forming a magnetic brush of the two-component type developer on the developer-carrying member, (C) causing the magnetic brush to contact a latent image-bearing member, and (D) developing an electrostatic image on the latent image-bearing member to form a toner image while applying an alternating electric field to the developer-carrying member.

According to a further aspect of the present invention, there is provided an image forming method wherein the above-mentioned steps (A)–(D) are repeated with at least a magenta developer, a cyan developer, and a yellow developer respectively, each satisfying the requirements of the above-mentioned two-component type developer, and a full color image is formed at least with the resultant magenta toner image, cyan toner image and yellow toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
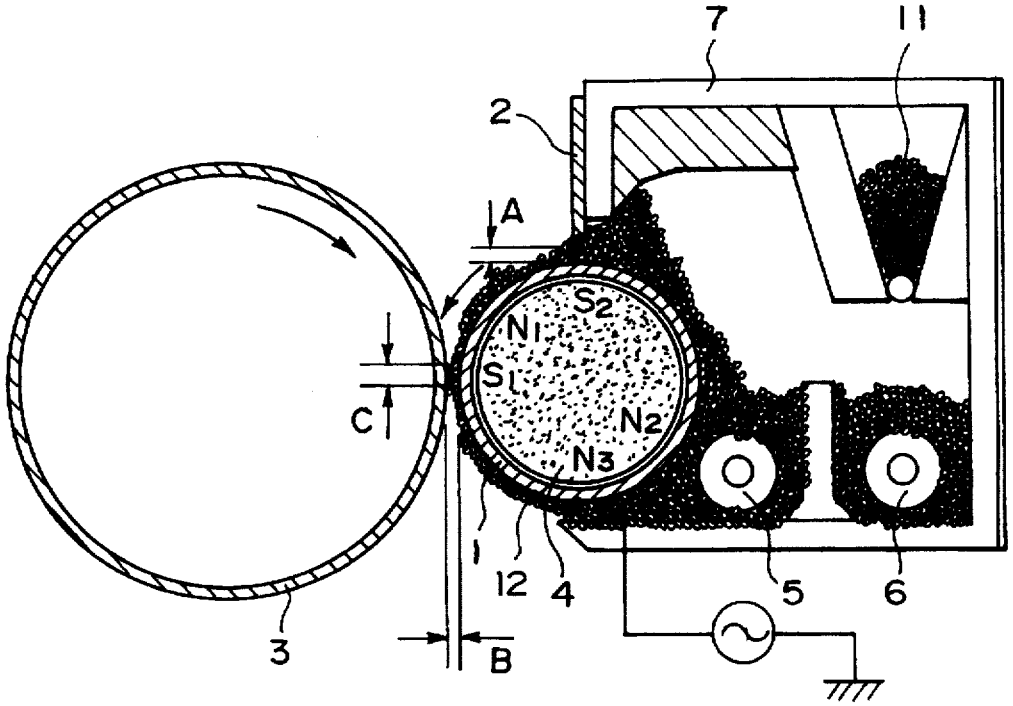
FIG. 1 is a schematic view of an apparatus for practicing an embodiment of the developing method according to the present invention.

As a result of our detailed study, it has been found possible to provide a dense magnetic brush at a developing pole and thus an image with a good dot reproducibility by using a magnetic carrier having a magnetization of 30–150 emu/cm$^3$ at a developing pole (at a magnetic field of ca. 1000 oersted) and a carrier particle size of 1–100 μm.

However, in contrast with an improved image quality, there has been observed an increased tendency of carrier attachment. For this reason, in the developer of the present invention, the magnetic carrier is so designed that (1) it has a number-average particle size of 1–100 μm and the particle size distribution is narrowed so as to contain at most 20% by number of particles thereof having a size in the range of at most a half of the number-average particle size, (2) the (electrical) resistivity thereof is increased so that it has a resistivity of at least $1\times10^{12}$ ohm.cm and has a core having an (electrical) resistivity of at least $1\times10^{10}$ ohm.cm, and (3) it has a magnetization at 1 kilo-oersted of 3– 150 emu/g. As a result, the image quality is improved while avoiding the carrier attachment.

The effectiveness of the above-designed factors may be correlated with an assumption that the driving force of carrier attachment in a contact development process using a magnetic brush under application of an alternating electric field is controlled by charge injection from the developing sleeve to the magnetic carrier under application of the developing bias voltage.

As another factor, it has been found that the carrier attachment is also related with charging of the magnetic carrier during triboelectrification between the toner and the magnetic carrier. The charged magnetic carrier is not likely to be attached to the photosensitive member because of a magnetic force acting thereon and its weight if it has a large particle size, but a fine powder fraction of the magnetic carrier can fly onto the photosensitive member.

The above-mentioned carrier attachment due to charge injection to the carrier can be caused even by a coated magnetic carrier, if the core is composed of a material such as metallic iron, magnetite or ferrite providing the core with a resistivity of $9\times10^8$ ohm.cm or below and when the core is exposed to the surface of the magnetic carrier particles even partially to cause charge injection. It has been also found that such charge injection is also caused by a magnetic resin carrier containing a dispersed magnetic material if it has a resistivity below $9\times10^9$ ohm.cm.

It has been also found that a magnetic carrier having a broad particle size distribution and containing a large amount of fine powder results in an increased carrier attachment.

Accordingly, the carrier attachment can be effectively prevented by using a magnetic carrier comprising core particles having a high resistivity so as to provide an increased bulk resistivity and prevent charge injection and containing little fine powder fraction.

However, a magnetic resin carrier designed to prevent carrier attachment due to charge injection can fail to effect a satisfactory charge control of various toners when it is used without a surface coating. Further, a carrier containing a smaller amount of magnetic material has shown an unstable triboelectric charge-imparting effect to a toner in some cases, while the reason therefor is not clear.

In a preferred embodiment of the present invention, the magnetic carrier comprises a high resistivity core effective for preventing charge injection and a resin coating on the core so as prevent carrier attachment and ensure a good charge-imparting ability to toner.

As a magnetic carrier structure suitable for satisfactorily satisfying the charging ability and the carrier attachment preventing performance by containing a large amount of metal oxide to provide a high core resistivity, a portion of magnetic fine particles may be replaced with metal oxide particles having a higher resistivity and a larger particle size, so as to provide an apparently smaller metal oxide/binder ratio in the vicinity of the magnetic carrier particle surface, thereby providing a higher carrier bulk resistivity to satisfy a higher image quality and satisfactorily prevent carrier attachment. Particularly in the case of producing a magnetic carrier core by directly polymerizing a monomer in the presence of metal oxides, the larger metal oxide particles are exposed to and project out of the surface. A larger particle size ratio provides a larger rate of projection of the larger particles. Accordingly, it is believed possible to increase the bulk electrical resistivity of the carrier core by introducing high-resistivity metal oxide particles having a larger particle size than the ferromagnetic particles. Further, by using a thermosetting resin as the binder, the core particles can be satisfactorily coated with a resin regardless of whether a wet or dry coating process is used, thereby being able to provide a good ability of charging a toner.

By using the above-mentioned carrier, it is possible to provide toner images at an improved reproducibility of dots constituting an electrostatic image. It is assumed that the deterioration of dot reproducibility is caused by leakage of charge from an electrostatic image on the photosensitive drum due to rubbing of the electrostatic image with a magnetic carrier, and dots of a digital electrostatic latent image are caused to have non-uniform shapes in the vicinity of the leakage cite. It is also assumed that the magnetic carrier used in the present invention does not disturb a digital latent image because of an increased core resistivity.

By using the magnetic carrier having a magnetization of 30–150 emu/cm$^3$, the two-component type developer according to the present invention provides a dense magnetic brush at a developing pole. Further, by using a core having an increased bulk resistivity and reducing a fine powder fraction of the carrier, the charge injection is prevented so as to allow a development while preventing charge injection and disorder of a latent image, thereby providing high-quality images.

It is difficult to effect the prevention of fog and the improved reproducibility of dots constituting an electrostatic image only by improvement of a magnetic carrier. As the image quality of a final image is affected by charging of a toner and an interaction between a toner and a magnetic carrier, the improvement of a toner is also necessary.

Images free of fog and having a good dot reproducibility can be obtained by using a toner having a weight-average particle size of 1–10 μm and a sharp particle size distribution such that the toner particles contain at most 20% by number of particles having sizes in the range of at most a half of the number-average particle size thereof and contain at most 10% by volume of particles having sizes in the range of at most two times the weight-average particle size thereof, in combination with a magnetic carrier having a sharp particle size distribution given by removing fine powder fraction thereof. This is considered because, in the triboelectrification of a toner with a magnetic carrier, the resultant triboelectric charge distribution of the toner is narrowed by using a toner having a sharp particle size distribution, and the opportunity of contact between the toner and the carrier is equalized because the magnetic carrier particles have uniform particle size. As a result, a more uniform triboelectrification becomes possible, so that the toner is provided with a sharp triboelectric charge distribution and the occurrence of a reverse toner fraction (i.e., a toner fraction charged in a reverse polarity) is minimized.

The developer according to the present invention is unlikely to be deteriorated and can continually provide high-quality images similarly as at the initial stage presumably for the following reason.

It is considered that a developer is deteriorated during a long period of use thereof because the toner and the magnetic carrier are damaged primarily due to a magnetic shear or gravitational shear acting between the toner and the carrier or between the carrier particles in the developing vessel. Particularly the fiber powder fractions of both the toner and the carrier are more liable to cause sticking and deterioration. The toner is basically consumed, but the magnetic carrier is repeatedly used without being consumed so that the damage given to the surface thereof is accumulated.

In this instance, if a magnetic carrier having a low magnetic force and a sharp particle size distribution is used in combination with a toner having a sharp particle size distribution, the magnetic shear acting between the toner and the carrier and between the carrier particles may be reduced to reduce the surface damage exerted to the carrier particles.

A smaller particle size of magnetic carrier is preferred from the viewpoint of a higher image quality but is liable to increase the carrier attachment based on a relation between the magnetic force and the particle size. From these viewpoints in combination, the magnetic carrier used in the present invention may have a number-average particle size in the range of 1–100 μm and may preferably have a number-average particle size of 5–35 μm when the magnetic carrier has a magnetization of 100–150 emu/cm$^3$, so as to provide high image quality and prevent the carrier attachment. On the other hand, when the magnetic carrier has a magnetization of 30–100 emu/cm$^3$, the magnetic carrier may preferably have a number-average particle size in the range of 35–80 μm so as to provide high image quality, prevent the carrier attachment and prevent the developer deterioration. A carrier having a number-average particle size in excess of 100 μm is not preferred from the viewpoint of high image quality because the magnetic brush is liable to leave a rubbing trace on the photosensitive member surface. A carrier having a number-average particle size smaller than 1 μm is liable to cause the carrier attachment because of a small magnetic force per carrier particle.

It is important in the present invention that the magnetic carrier has a particle size distribution such that the carrier particles contain at most 20% by number of particles having sizes in the range of at most a half of the number-average particle size thereof. If the particles having sizes in the range of at most a half of the number-average particle size exceed 20% by number as an accumulative amount, the magnetic carrier is liable to cause an increased carrier attachment and have a poor charging ability to a toner. The method of measuring the particle size of magnetic carrier particles relied on herein will be described hereinafter.

As for the magnetic properties of the magnetic carrier used in the present invention, it is important to use a magnetic carrier having a magnetization of 30–150 emu/cm$^3$ at 1 kilo-oersted. It is further preferred to use a magnetic carrier having a magnetization of 40–130 emu/cm$^3$ and exerting a low magnetic force. As has been described above, the magnetization of the magnetic carrier may be appropriately selected depending on the particle size of the carrier. While being also affected by the particle size, a magnetic carrier having a magnetization in excess of 150 emu/cm$^3$ is liable to result in a magnetic brush formed on a developer sleeve at developing pole having a low density and comprising long and rigid ears, thus being liable to result in rubbing traces in the resultant toner images and image defects, such as roughening of halftone images and irregularity of solid images, particularly due to deterioration in long continuous image formation on a large number of sheets. Below 30 emu/cm$^3$, the magnetic carrier is caused to exert only an insufficient magnetic force to result in a lower toner-conveying performance.

The magnetic properties referred to herein are values measured by using an oscillating magnetic field-type magnetic property auto-recording apparatus ("BHV-30", available from Riken Denshi K.K.). Specific conditions for the measurement will be described hereinafter.

It is important that the magnetic carrier used in the present invention has an (electrical) resistivity of at least $1\times10^{12}$ ohm.cm at an electric field intensity of $5\times10^4$ V/m. If the resistivity is below $1\times10^{12}$ ohm.cm, the above-mentioned carrier attachment and image quality degradation in the process of developing electrostatic latent images are liable to be caused, thus failing to accomplish the objects of the present invention, such as provision of higher image quality and higher resolution. The method of measuring the resistivity of magnetic carrier powder referred to herein will be described hereinafter.

It is important that the magnetic carrier has a core having a resistivity of at least $1\times10^{10}$ ohm.cm at an electric field intensity of $5\times10^{14}$ V/m. If the resistivity is below $1\times10^{10}$ ohm.cm, even a coated carrier is liable to cause charge injection and charge leakage from an electrostatic image when the core is even partly exposed, thus being liable to cause carrier attachment and a lowering in dot reproducibility.

The core of the magnetic carrier may preferably comprise magnetite or ferrite showing magnetism as represented by a general formula of $MO.Fe_2O_3$ or $MFe_2O_4$, wherein M denotes a divalent or monovalant metal, such as Mn, Fe, Ni, Co, Cu, Mg, Zn, Cd, or Li. M denotes a single species or plural species of metals. Specific examples of the magnetite or ferrite may include: iron-based oxide materials, such as magnetite, γ-iron oxide, Mn-Zn-based ferrite, Ni-Zn-based ferrite, Mn-Mg-based ferrite, Li-based ferrite, and Cu-Zn-based ferrite. Among these, magnetite is most preferably used.

Examples of another metal oxide may include: non-magnetic metal oxides including one or plural species of metals, such as Mg, Al, Si, Ca, Sc, Ti, V, Cr, Mn, Fe, Co, Ni, Cu, Zn, Sr, Y, Zr, Nb, Mo, Cd, Sn, Ba and Pb; and metal oxides showing magnetism as described above. Specific examples of non-magnetic metal oxides may include: $Al_2O_3$, $SiO_2$, CaO, $TiO_2$, $V_2O_5$, $CrO_2$, $MnO_2$, $Fe_2O_3$, CoO, NiO, ZnO, SrO, $Y_2O_3$ and $ZrO_2$.

The carrier core can consist of a metal oxide as described above alone. In this instance, however it is necessary to increase the resistivity to $1\times10^{10}$ ohm.cm or higher, e.g., by intensely oxidizing the core surface. A more preferred form of carrier may comprise a carrier core obtained by dispersing a metal oxide as described above in a resin. In this instance, it is possible to disperse a single species of metal oxide in the resin, but it is particularly preferred to disperse at least two species of metal oxides in mixture in the resin. In the latter case, it is preferred to use plural species of particles having similar specific gravities and/or shapes in order to provide an increased adhesion and a high carrier strength. Examples of preferred combination may include: magnetite and hematite ($\alpha$-$Fe_2O_3$), magnetite and $\gamma$-$Fe_2O_3$, magnetite and $SiO_2$, magnetite and $Al_2O_3$, magnetite and $TiO_2$, and magnetite and Cu-Zn-based ferrite. Among these, the combination of magnetite and hematite is preferred in view of the price and the resultant carrier strength.

In the case of dispersing the above-mentioned metal oxide in a resin to provide core particles, the metal oxide showing magnetism may preferably have a number-average particle size of 0.02–2 μm while depending on the objective carrier particle size. In the case of dispersing two or more species of metal oxides in combination, a metal oxide showing magnetism may preferably have a number-average particle size ra of 0.02–2 μm, and another metal oxide preferably having a higher resistivity than the magnetic metal oxide may preferably have a number-average particle size rb of 0.05–5 μm. In this instance, a ratio rb/ra may preferably exceed 1.0. If the ratio is 1.0 or below, it is difficult to form a state that the metal oxide particles having a higher resistivity are exposed to the core particle surface, so that it becomes difficult to sufficiently increase the core resistivity and obtain an effect of preventing the carrier attachment. On the other hand, if the ratio exceeds 5.0, it becomes difficult to enclose the metal oxide particles in the resin, thus being liable to result in a lower magnetic carrier strength and break the carrier. The method of measuring the particle size of metal oxides referred to herein will be described hereinafter.

Regarding the metal oxides dispersed in the resin, the magnetic particles may preferably have a resistivity of at least $1\times10^3$ ohm.cm. Particularly, in the case of using two or more species of metal oxides in mixture, magnetic metal oxide particles may preferably have a resistivity of at least $1\times10^3$ ohm.cm, and preferably non-magnetic other metal oxide particles may preferably have a resistivity higher than that of the magnetic metal oxide particles. More preferably, the other metal oxide particles may have a resistivity of at least $10^8$ ohm.cm. If the magnetic particles have a resistivity below $1\times10^3$ ohm.cm, it is difficult to have a desired resistivity of carrier even if the amount of the metal oxide dispersed is reduced, thus being liable to cause charge injection leading to inferior image quality and invite the carrier attachment. In the case of dispersing two or more metal oxides, if the metal oxide having a larger particle size has a resistivity below $1\times10^8$ ohm.cm, it becomes difficult to sufficiently increase the carrier core resistivity, thus being difficult to accomplish the object of the present invention. The method of measuring resistivities of metal oxides referred to herein will be described hereinafter.

The metal oxide-dispersed resin core used in the present invention may preferably contain 50–99 wt. % of the metal oxide. If the metal oxide content is below 50 wt. %, the charging ability of the resultant magnetic carrier becomes unstable and, particularly in a low temperature-low humidity environment, the magnetic carrier is charged and is liable to have a remanent charge, so that fine toner particles and an external additive thereto are liable to be attached to the surfaces of the magnetic carrier particles. In excess of 99 wt. %, the resultant carrier particles are caused to have an insufficient strength and are liable to cause a difficulty of carrier particle breakage during a continuous image formation.

As a further preferred embodiment of the present invention, in the metal oxide-dispersed resin core containing two or more species of metal oxides dispersed therein, the magnetic metal oxide may preferably occupy 30–95 wt. % of the total metal oxides. A content of below 30 wt. % may be preferred to provide a high-resistivity core, but results in a carrier exerting a small magnetic force, thus inviting the carrier attachment in some cases. Above 95 wt. %, it becomes difficult to increase the core resistivity while depending on the resistivity of the magnetic metal oxide.

The binder resin constituting the metal oxide-dispersed resin core used in the present invention may comprise a vinyl resin; a non-vinyl condensation type resin, such as polyester resin, epoxy resin, phenolic resin, urea resin, polyurethane resin, polyimide resin, cellulosic resin or polyether resin; or a mixture of such a non-vinyl resin and a vinyl resin.

Examples of vinyl monomer for providing the vinyl resin may include: styrene; styrene derivatives, such as o-methylstyrene, m-methylstyrene, p-methylstyrene, p-phenylstyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; ethylenically unsaturated monoolefins, such as ethylene, propylene, butylene and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate methacrylic acid; methacrylates, such as methyl methacrylate, ethyl methacrylate, propyl methacrylate, n-butyl methacrylate, isobutyl methacrylate, n-octyl methacrylate,, dodecyl methacrylate, 2-ethylhexyl methacrylate, stearyl methacrylate, and phenyl methacrylate; acrylic acid; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; and acrolein. These may be used singly or in mixture of two or more species to form a vinyl resin.

In producing the magnetic metal oxide-dispersed core particles, starting materials including a vinyl or non-vinyl thermoplastic resin, magnetic metal oxide particles and other additives such as a hardening agent may be sufficiently blended by a blender, and melt-kneaded through kneading means, such as hot rollers, a kneader or an extruder, followed by cooling, pulverization and classification to obtain carrier core particles. The resultant resinous core particles may preferably be spherized (i.e., made spherical) thermally or mechanically to provide spherical core particles.

In addition to the above-mentioned process including melt-kneading and pulverization, the magnetic metal oxide-dispersed core particles may also be prepared by subjecting a mixture of a monomer and a metal oxide to polymerization to directly provide carrier core particles. Examples of the monomer used for the polymerization may include the above-mentioned vinyl monomers, a combination of a bisphenol and epichlorohydrin for producing epoxy resins; a combination of a phenol and an aldehyde for producing phenolic resins; a combination of urea and an aldehyde for producing a urea resin; and a combination of melamine and an aldehyde. For example, a carrier core including cured phenolic resin may be produced by subjecting a phenol and an aldehyde in mixture with a metal oxide as described above to suspension polymerization in the presence of a basic catalyst and a dispersion stabilizer in an aqueous medium.

As a process for producing particularly preferred carrier core particles, it is preferred to crosslink the binder resin in order to increase the strength of the carrier core and provide a better coating state with a resin. The crosslinking may be effected, e.g., by performing the melt-kneading in the presence of a crosslinking component to cause crosslinking in the kneading step; polymerizing a monomer of a type providing a cured resin in the presence of a metal oxide; or polymerizing a monomer composition including a crosslinking component in the presence of a metal oxide.

It is important that the magnetic carrier used in the present invention is prepared by coating the carrier core particles with a resin appropriately selected to provide a required level of a toner-charging ability. The coating amount of the resin may preferably be in the range of 0.5–10 wt. %, particularly 0.6–5 wt. %, respectively based on the carrier weight. In the case of the metal oxide-dispersed resin carrier, it is preferred that the density of exposed metal oxide particles is at most 5 particles/$\mu m^2$, particularly at most 3 particles/$\mu m$, at the coated carrier surface, so as to satisfactorily prevent the carrier attachment.

The coating resin used in the present invention may suitably be an insulating resin, which may be either a thermoplastic resin or a thermosetting resin. Examples of the thermoplastic resin may include: polystyrene; acrylic resins, such as polymethyl methacrylate, and styrene-acrylic acid copolymer; styrene-butadiene copolymer, ethylene-vinyl acetate copolymer, vinyl chloride resin, vinyl acetate resin, polyvinylidene fluoride resin, fluorocarbon resin, perfluorocarbon resin, solvent-soluble perfluorocarbon resin, polyvinyl alcohol, polyvinyl acetal polyvinylpyrrolidone, petroleum resin, cellulose; cellulose derivatives, such as cellulose acetate, nitrocellulose, methyl cellulose, hydroxymethyl cellulose, hydroxyethyl cellulose, and hydroxypropyl cellulose; novalak resin, low-molecular weight polyethylene, saturated alkyl polyester resins; aromatic polyester resins, such as polyethylene terephthalate, polybutylene terephthalate, and polyarylate; polyamide resin, polyacetal resin, polycarbonate resin, polyethersulfone resin, polysulfone resin, polyphenylene sulfide resin, and polyether ketone resin.

Examples of the thermosetting (or cured) resin may include: phenolic resin, modified phenolic resin, maleic resin, alkyd resin, epoxy resin, acrylic resin, unsaturated polyesters obtained by polycondensation among maleic anhydride, terephthalic acid and polyhydric alcohol, urea resin, melamine resin urea-melamine resin, xylene resin, toluene resin, guanamine resin, melamine-guanamine resin, aetoguanamine resin, glyptal resin, furan resin, silicone resin, polyimide resin, polyamideimide resin, polyetherimide resin, and polyurethane resin. These resins may be used singly or in mixture. It also possible to use mixture of a thermoplastic resin and a curing or hardening agent to provide a cured resin.

The coated magnetic carrier may preferably be produced through by spraying a coating resin solution onto carrier core particles in a floating or fluidized state to form a coating film on the core particle surfaces, or spray drying. This coating method may suitably be used for coating the magnetic carrier-dispersed resin core particles with a thermoplastic resin.

Other coating methods may include gradual evaporation of the solvent in a coating resin solution in the presence of a metal oxide under application of a shearing force. More specifically, the solvent evaporation may be performed at a temperature above the glass transition point of the coating resin, and the resultant clustered metal oxide particles may be then disintegrated. Alternatively, the coating film may be cured under heating, followed by disintegration.

The metal oxide used in the present invention may preferably have a bulk density of at most 3.0 g/cm$^3$. Above 3.0 g/cm$^3$, a large shearing force is exerted within the developer to be liable to cause melt-sticking of toner onto the carrier and peeling of the coating resin. The bulk density of the carrier may be measured according to JIS K5101.

The metal oxide may have a particle shape suitably selected for a developing system used. However, the metal oxide used in the present invention may preferably have a sphericity of at most 2. If the sphericity exceeds 2, the resultant developer is caused to have a poor fluidity and provides a magnetic brush of an inferior shape, so that it becomes difficult to obtain high-quality toner images. The sphericity of a carrier may be measured, e.g., by sampling 300 carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

$$Sphericity(SF1)=[(MX\ LNG)^2/AREA]\times\pi/4,$$

wherein MX LNG denotes the maximum diameter of a carrier particle, and AREA denotes the projection area of the carrier particle. As the sphericity is closer to 1, the shape is closer to a sphere.

For the magnetic carrier used in the present invention, the carrier particle size and the magnetization are important parameters. As a measure of high image quality, a carrier image quality parameter KP may be defined from the carrier particle size and the magnetization as follows.

$$KP=I\times D,$$

wherein I denotes the magnetization [emu/cm$^3$) of a carrier, and D denotes the particle size (cm) of the carrier.

The magnetic carrier used in the present invention may preferably have a carrier image quality parameter KP satisfying $$0.08<KP<1.0\ \text{emu/cm}^2$$

more preferably $$0.1<KP<0.8\ \text{emu/cm}^2.$$

If KP is below 0.08 emu/cm$^2$, the constraint force exerted by the sleeve onto the magnetic brush may be small so that it may be difficult to well prevent the carrier attachment in some cases. Above 1.0 emu/cm$^2$ the resultant magnetic brush is liable to have a low density and becomes rigid, thus failing to accomplish high image qualities in some cases.

The toner used in the present invention may have a weight-average particle size (D4) of 1–10 μm, preferably 3–8 μm. Further, in order to effect good triboelectrification free from occurrence of reverse charge fraction and good reproducibility of latent image dots, it is important to satisfy such a particle size distribution that the toner particles contain at most 20% by number in accumulation of particles having particle sizes in the range of at most a half of the number-average particle size (D1) thereof and contain at most 10% by volume in accumulation of particles having particle sizes in the range of at least two times the weight-average particle size (D4) thereof. In order to provide a toner with further improved triboelectric chargeability and dot reproducibility, it is preferred that the toner particles contain at most 15% by number, further preferably at most 10% by number, of particles having sizes of at most D½, and at most 5% by volume, further preferably at most 2% by volume of particles having sizes of at least 2×D4.

If the toner has a weight-average particle size (D4) exceeding 10 μm, the toner particles for developing electrostatic latent images become so large that development faithful to the latent images cannot be performed and extensive toner scattering is caused when subjected to electrostatic transfer. If D4 is below 1 μm, the toner causes difficulties in powder handling characteristic.

If the cumulative amount of particles having sizes of at most a half of the number-average particle size (D1) exceeds 20% by number, the triboelectrification of such fine toner particles cannot be satisfactorily effected to result in difficulties, such as a broad triboelectric charge distribution of the toner, charging failure (occurrence of reverse charge fraction) and a particle size change during continuous image formation due to localization of toner particle sizes. If the cumulative amount of particles having sizes of at least two times the weight-average particle size (D4) exceeds 10% by volume, the triboelectrification with the metal oxide becomes difficult, and faithful reproduction of latent images becomes difficult. The toner particle size distribution may be measured, e.g., by using a Coulter counter.

The particle size of the toner used in the present invention is closely associated with the particle size of the magnetic carrier. A toner weight-average particle size of 3–8 μm is desired in order to provide a better chargeability and high-quality image formation, when the magnetic carrier has a number-average particle size of 35–80 μm. On the other hand, when the magnetic carrier has a number-average particle size of 5–35 μm, it is preferred that the toner has a weight-average particle size of 1–6 μm in order to prevent the developer deterioration and high-quality image formation at initial stage and particularly in continuous image formation.

The toner used in the present invention, may comprise a binder resin, examples of which may include: polystyrene; polymers of styrene derivatives, such as poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, and styrene-acrylonitrile-indene copolymer; polyvinyl chloride, phenolic resin, natural or modified phenolic resin, natural or modified maleic acid resin, acrylic resin, methacrylic resin, polyvinyl acetate, silicone resin; polyester resins having a structural unit selected from, aliphatic polyhydric alcohols, aromatic polyhydric alcohols or diphenols, and aliphatic dicarboxylic acids or aromatic dicarboxylic acids; polyurethane resin, polyamide resin, polyvinyl butyral, terpene resin, coumarone-indene resin, petroleum resin, crosslinked styrene-based resins, and crosslinked polyester resins.

Examples of the comonomer to be used in combination with a styrene monomer for providing styrene copolymers may include vinyl monomers, including: acrylic acid; acrylic acid esters or derivatives thereof, such as methyl acrylate, ethyl acrylate, butyl acrylate, dodecyl acrylate, octyl acrylate, 2-ethylhexyl acrylate, phenyl acrylate, methyl methacrylate, ethyl methacrylate, butyl methacrylate, octyl methacrylate, acrylonitrile, methacrylonitrile, and acrylamide; maleic acid; half esters and diesters of maleic acid, such as butyl maleate, methyl maleate, and dimethyl maleate; vinyl esters, such as vinyl acetate and vinyl chloride; vinyl ketones, such as vinyl methyl ketone, and vinyl hexyl ketone; and vinyl ethers, such as vinyl methyl ether and vinyl ethyl ether.

The crosslinking agent may principally comprise a compound having at least two polymerizable double bonds. Examples thereof may include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide and divinyl sulfone; and compounds having three or more ethylenic double bonds. These compounds may be used alone or in mixture. At the time of synthesis of a binder resin, the crosslinking agent may preferably be used in a proportion of 0.01–10 wt. %, further preferably 0.05–5 wt. %, based on the binder resin.

In the case of using a pressure-fixation system, it is possible to use a binder resin for a pressure-fixable toner, examples of which may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyester, paraffin, and other waxes.

The toner used in the present invention can be used in combination with a charge control agent which is incorporated in (internally added to) or blended with (externally added to) the toner particles. By the addition of a charge control agent, it becomes possible to effect an optimum charge control depending on a developing system used. Examples of a positive charge control agent may include: nigrosine and modified products thereof with aliphatic acid metal salts; quaternary ammonium salts, such as tributylbenzylammonium-1-hydroxy-4-naphthosulfonate, and tetrabutylammonium tetrafluoroborate; diorganotin oxides, such as dibutyltin oxide, dioctyltin oxide, dicyclohexyltin oxide; dibutyltin borate, dioctyltin borate, and dicyclohexyltin borate. These compounds may be used singly or in combination of two or more species. Among these, nigrosine-based compounds and quaternary ammonium salts are particularly preferred.

Alternatively, in the present invention, it is also possible to use a negative charge control agent, such as organic metal salts, organic metal complexes, and chelate compounds. Among these, acetylacetone metal complexes (inclusive of monoalkyl-substituted and dialkyl-substituted derivatives), salicylic acid metal complexes (inclusive of monoalkyl-substituted and dialkyl-substituted derivatives), and their corresponding salts are preferred. Salicylic acid-based metal complexes or salicylic acid-based metal salts are particularly preferred. Specific examples of preferred negative charge control agent may include: aluminum acetylacetonate, iron (II) acetylacetonate, 3,5-di-tert-butylsalicylic acid chromium complex or salt, and 3,5-di-tert-butylsalicylic acid zinc complex or salt.

When internally added to the toner, the above charge control agent may preferably be used in a proportion of 0.1–20 wt. parts, particularly 0.2–10 wt. parts, per 100 wt. parts of the binder resin. When used for color image formation, it is preferred to use a colorless or pale-colored charge control agent.

As the colorant for the toner, it is possible to use a dye and/or a pigment known heretofore. Examples thereof may include: carbon black, Phthalocyanine Blue, Peacock Blue, Permanent Red, Lake Red, Rhodamine Lake, Hansa Yellow, Permanent Yellow and Benzidine Yellow. The colorant may be added in an amount of 0.1–20 wt. parts, preferably 0.5–20 wt. parts, per 100 wt. parts of the binder resin. In order to provide a fixed toner image having a good transparency or an OHP film, the colorant may preferably be added in a proportion of at most 12 wt. parts, further preferably 0.5–9 wt. parts, per 100 wt. parts of the binder resin.

The toner constituting the developer according to the present invention can further contain a wax, such as polyethylene, low-molecular weight polypropylene, microcrystalline wax, carnauba wax, sasol wax or paraffin wax in order to improve the releasability at the time of hot pressure fixation.

The toner used in the present invention may suitably be used in mixture with fine powder externally added thereto, inclusive of fine particles of inorganic materials, such as silica, alumina and titanium oxide; and fine particles of organic materials, such as polytetrafluoroethylene, polyvinylidene fluoride, polymethyl methacrylate, polystyrene and silicone resin. If such fine powder is externally added to the toner, the fine powder is caused to be present between the toner and carrier particles, or between the toner particles, so that the developer may be provided with an improved flowability and an improved life. The above-described fine powder may preferably have an average particle size of at most 0.2 μm. If the average particle size exceeds 0.2 μm, the flowability-improving effect is scarce, and the image quality can be lowered due to insufficient flowability during development or transfer in some cases. The method of measuring the particle size of such fine powder referred to herein will be described hereinafter.

Such fine powder may preferably have a specific surface area of at least 30 $m^2/g$, particularly 50–400 $m^2/g$, as measured by the BET method using nitrogen adsorption. The fine powder may suitably be added in a proportion of 0.1–20 wt. parts per 100 wt. parts of the toner.

In preparing the toner constituting the developer according to the present invention, the binder resin of a vinyl-type or non-vinyl-type thermoplastic resin, a colorant, an optional charge control agent and other additives may be sufficiently blended in a mixer and then melt-kneaded by a hot kneading means, such as heated rollers, a kneader or an extruder to compatibly knead the resins and disperse or dissolve therein the pigment or dye. The thus-kneaded product is thereafter cooled for solidification, pulverized and classified to obtain toner particles. For the toner classification, it is preferred to use a multi-division classification apparatus utilizing an inertia force (the Coanda effect). By using the apparatus, a toner having the particle size distribution defined by the present invention can be produced efficiently.

The toner particles thus obtained can be used as they are but may preferably be used in mixture with fine powder externally added thereto as described above.

The mixing of the toner and the fine powder may be effected by using a blender, such as a Henschel mixer. The resultant toner carrying such an external additive is mixed with the magnetic carrier to provide a two-component type developer. In the two-component type developer, the toner may preferably occupy 1×20 wt. %, more preferably 1–10 wt. %, in a typical case while it can depend on the developing process. The toner in the two-component type developer may suitably be provided with a triboelectric charge of 5–100 μC/g, most preferably 5–60 μC/g. The method of measuring triboelectric charges referred to herein will be described hereinafter.

The developing method according to the present invention may for example be performed by using a developing means as shown in FIG. 1. It is preferred to effect a development in a state where a magnetic brush contacts a latent image-bearing member, e.g., a photosensitive drum 3 under application of an alternating electric field. A developer-carrying member (developing sleeve) 1 may preferably be disposed to provide a gap B of 100–1000 μm from the photosensitive drum 3 in order to prevent the toner attachment and improve the dot reproducibility. If the gap is narrower than 100 μm, the supply of the developer is liable to be insufficient to result in a low image density. In excess of 1000 μm, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 1 with the photosensitive drum 3 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 2 and the developing sleeve 1 and/or changing the gap B between the developing sleeve 1 and the photosensitive drum 3.

The image forming method according to the present invention may be particularly effectively used in formation of a full color image for which a halftone reproducibility is a great concern by using at least 3 developing devices for magenta, cyan and yellow, adopting the developers and developing method according to the present invention and preferably adopting a developing system for developing digital latent images in combination, whereby a development faithful to a dot latent image becomes possible while avoiding an adverse effect of the magnetic brush and disturbance of the latent image. The use of the toner having a sharp particle size distribution with removal of fine powder fraction is also effective in realizing a high transfer ratio in a subsequent transfer step. As a result, it becomes possible to high image qualities both at the halftone portion and the solid image portion.

In addition to the high image quality at an initial stage of image formation, the use of the two-component type developer according to the present invention is also effective in avoiding the lowering in image quality in a continuous image formation on a large number of sheets because of a low shearing force acting on the developer in the developer vessel.

In order to provide full color images giving a clearer appearance, it is preferred to use four developing devices for magenta, cyan, yellow and black, respectively, and finally effect the black development.

An image forming apparatus suitable for practicing full-color image forming method according to the present invention will be described with reference to FIG. 3.

Figure 3:
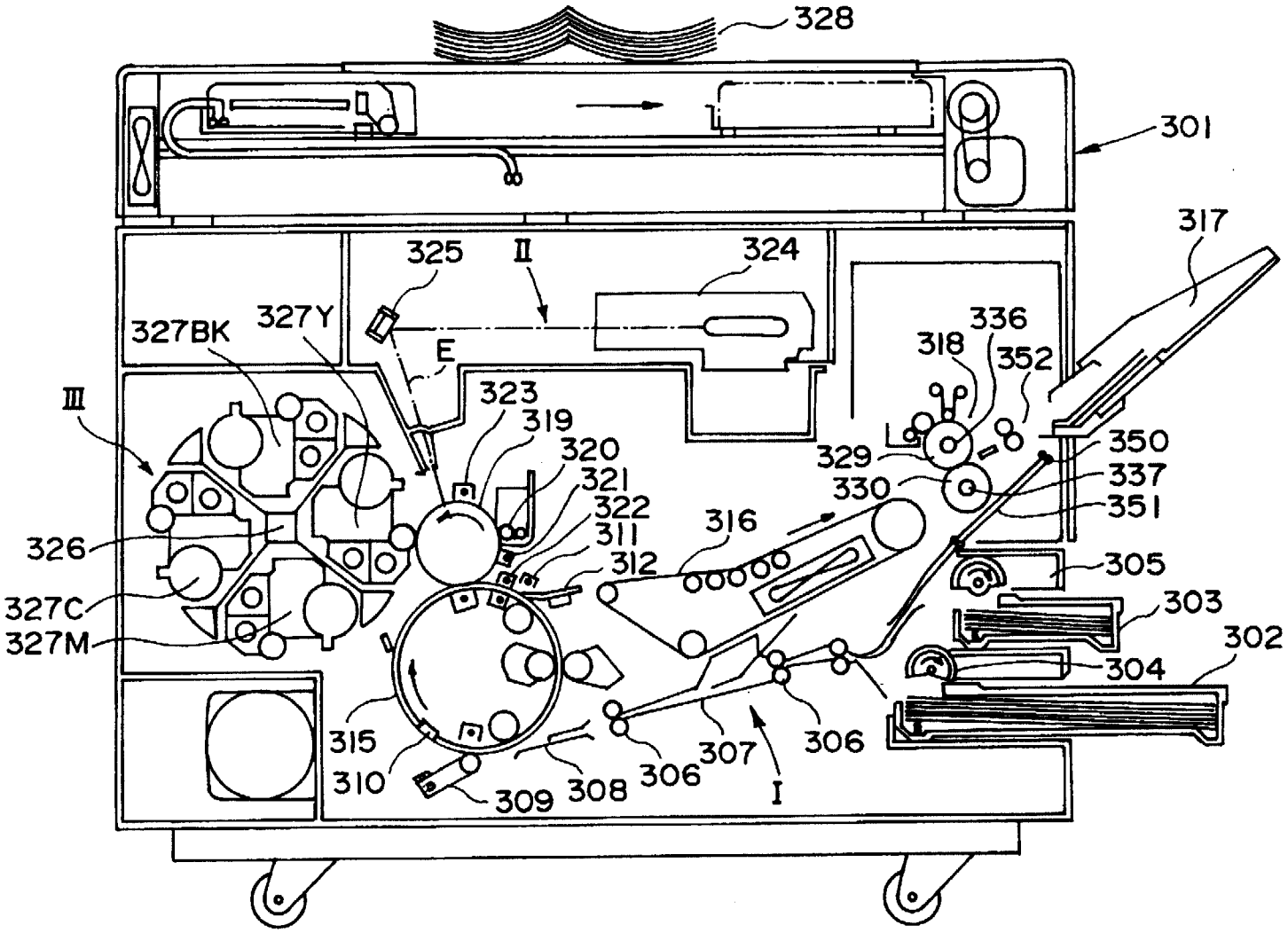
FIG. 3 is a schematic view of an apparatus for practicing an embodiment of the image forming method according to the present invention.

The color electrophotographic apparatus shown in FIG. 3 is roughly divided into a transfer material (recording sheet) -conveying section I including a transfer drum 315 and extending from the right side (the right side of FIG. 3) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly 301, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a glipper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly 301.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 3, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the glipper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 3).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by imagewise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the glipper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Alternatively, the respective color toner images can be once transferred onto an intermediate transfer member and then transferred to a transfer material to be fixed thereon.

The fixing speed of the fixing device is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

Now, methods for measuring various properties referred to herein will be described.

[Particle size of carrier]

At least 300 particles (diameter of 0.1 μm or larger) are taken at random from a sample carrier by observation through an optical microscope at a magnification of 100–5000, and an image analyzer (e.g., "Luzex 3" available from Nireco K.K.) is used to measure the horizontal FERE diameter of each particle as a particle size, thereby obtaining a number-basis particle size distribution and a number-average particle size, from which the number-basis proportion of particles having sizes in the range of at most a half of the number-average particle size is calculated.

[Magnetic properties of a magnetic carrier]

Measured by using an oscillating magnetic field-type magnetic property automatic recording apparatus ("BHV-30", available from Riken Denshi K.K.). A magnetic carrier is placed in an external magnetic field of 1 kilo-oersted to measure its magnification. More specifically, a magnetic carrier powder sample is sufficiently tightly packed in a cylindrical plastic cell having a volume of ca. 0.07 $cm^3$ so as not to cause movement of carrier particles during the movement. In this state, a magnetic moment is measured and divided by an actual packed sample volume to obtain a magnetization (intensity of magnetization) per unit volume.

[Measurement of (electrical) resistivity of carrier]

Figure 2:
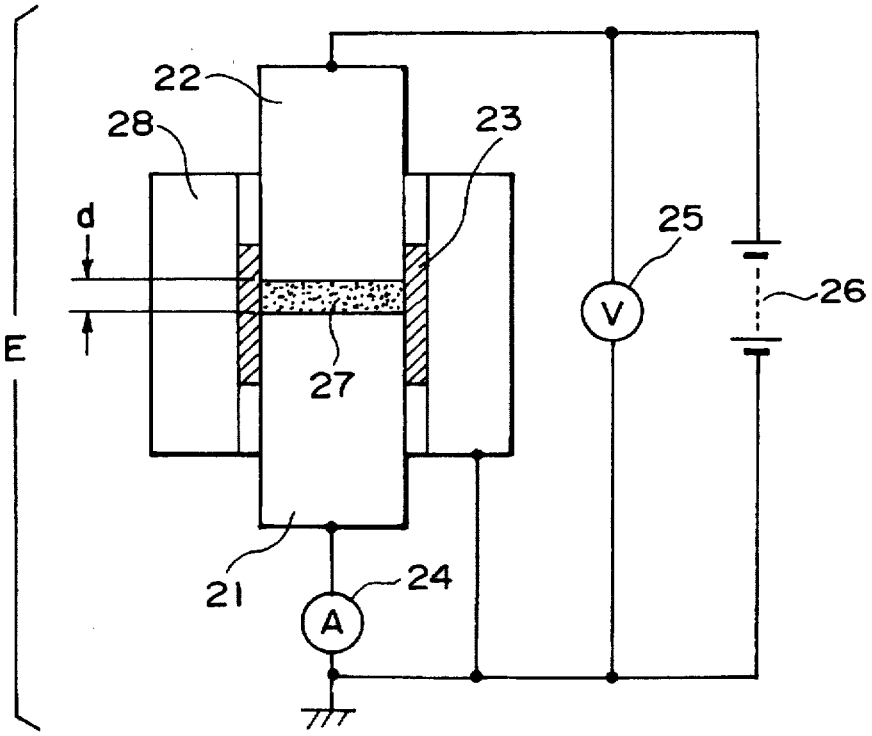
FIG. 2 is an illustration of an apparatus for measuring the (electrical) resistivity of a magnetic carrier, a carrier core and a metal oxide.

The resistivity of a carrier is measured by using an apparatus (cell) E as shown in FIG. 2 equipped with a lower electrode 21, an upper electrode 22, an insulator 23, an ammeter 24, a voltmeter 25, a constant-voltage regulator 26 and a guide ring 28. For measurement, the cell E is charged with ca. 1 g of a sample carrier 27, in contact with which the electrodes 21 and 22 are disposed to apply a voltage therebetween, whereby a current flowing at that time is measured to calculate a resistivity. As a magnetic carrier is in powder form so that care should be taken so as to avoid a change in resistivity due to a change in packing state. The resistivity values described herein are based on measurement under the conditions of the contact area between the carrier 27 and the electrode 21 or 12=ca. 2.3 $cm^2$, the carrier thickness=ca. 2 mm, the weight of the upper electrode 22=180 g, and the applied voltage=100 volts.

[Particle size of metal oxide]

Photographs at a magnification of 5,000–20,000 of a sample metal oxide powder are taken through a transmission electron microscope ("H-800", available from Hitachi Seisakusho K.K.). At least 300 particles (diameter of 0.01 μm or larger) are taken at random in the photographs and subjected to analysis by an image analyzer ("Luzex 3", available from Nireco K.K.) to measure a horizontal FERE diameter of each particle as its particle size. From the measured values for the at least 300 sample particles, a number-average particle size is calculated.

[Resistivity of metal oxide]

Measured similarly as the above-mentioned resistivity measurement for a carrier. A sample metal oxide is placed between and so as to evenly contact the electrodes 21 and 22 in a cell shown in FIG. 2 and, under this state, a voltage is applied between the electrodes to measure a current passing therebetween as a result, from which a resistivity is calculated. In order to ensure the uniform contact of the sample with the electrodes, the sample is packed while reciprocally rotating the lower electrode 21. The values described herein are based on measurement under the conditions of the contact area between the packed metal oxide and the electrodes S=ca. 2.3 $cm^2$, the sample thickness d=ca. 2 mm, the weight of the upper electrode 22=180 g, and the applied voltage=100 volts.

[Exposure density of metal oxide at carrier surface]

The density of exposure of metal oxide particles at the carrier surface of coated magnetic carrier particles is measured by using enlarged photographs at a magnification of 5,000–10,000 taken through a scanning electron microscope ("S-800", available from Hitachi Seisakusho K.K.) at an accelerating voltage of 1 kV. Each coated magnetic carrier particle is observed with respect to its front hemisphere to count the number of exposed metal oxide particles (i.e., the number of metal oxide particles protruding out of the surface) per unit area. Protrusions having a diameter of 0.01 μm or larger may be counted. This operation is repeated with respect to at least 300 coated metal oxide particles to obtain an average value of the number of exposed metal oxide particles per unit area.

[Particle size of toner]

Into 100–150 ml of an electrolyte solution (1%-NaCl aqueous solution), 0.1–5 ml of a surfactant (alkylbenzenesulfonic acid salt) is added, and 2–20 mg of a sample toner is added. The sample suspended in the electrolyte liquid is subjected to a dispersion treatment for 1–3 min. Then, the sample liquid is supplied to a Coulter counter ("Multisizer", available from Coulter Electronics Inc.) with an aperture size of, e.g., 17 μm or 100 μm, appropriately selected depending on the sample toner size level to obtain a volume-basis particle size distribution in the range of 0.3–40 μm, from which a number-basis particle size distribution, a number-average particle size (D1) and a weight-average particle size (D4) are calculated by a personal computer. From the number-basis distribution, the percentage by number of particles having sizes of at most a half of the number-average particle size is calculated. Similarly, from the volume-basis distribution, the percentage by volume of particles having sizes of at least two times the weight-average particle size is calculated.

[Triboelectric charge]

A toner and a magnetic carrier are weighed to provide a mixture containing 5 wt. % of the toner, and the mixture is subjected to mixing for 60 sec. by a Turbula mixer. The resultant powder mixture (developer) is placed in a metal container equipped with a 500-mesh electroconductive screen at the bottom, and the toner in the developer is selectively removed by sucking at a suction pressure of 250 mmHg through the screen by operating an aspirator. The triboelectric charge Q of the toner is calculated from a weight difference before and after the suction and a voltage resulted in a capacitor connected to the container based on the following equation:

$$Q(\mu C/g)=(C\times V)/(W_1-W_2),$$

wherein $W_1$ denotes the weight before the suction, $W_2$ denotes the weight after the suction, C denotes the capacitance of the capacitor, and V denotes the potential reading at the capacitor.

Hereinbelow, the present invention will be described based on Examples, wherein "parts" used for indicating the amount of components denotes "parts by weight".

EXAMPLE 1

| | |
|---|---|
| Phenol | 10 parts |
| Formalin (containing ca. 40 wt. % of formaldehyde, ca. 10 wt. % of methanol, and remainder of water) | 6 parts |
| Magnetite (ferromagnetic, $d_{av}$ (average particle size) = 0.24 μm, Rs (resistivity) = $5\times10^5$ ohm.cm) | 31 parts |
| β-$Fe_2O_3$ (hematite) (non-magnetic metal oxide, $d_{av}$ = 0.60 μm, Rs = $8\times10^9$ ohm.cm) | 53 parts |

The above materials, 4 parts of 28 wt. % ammonia water (basic catalyst) and 15 parts of water were placed in a flask and, under stirring for mixing, heated to 85° C. in 40 min., followed by holding at that temperature for 3 hours of curing reaction. Then, the content was cooled to 30° C., and 100 parts of water was added thereto, followed by removal of the supernatant and washing with water and drying in air of the precipitate. The dried precipitate was further dried at 50°–60° C. at a reduced pressure of at most 5 mmHg, thereby to obtain spherical magnetic carrier core particles containing the magnetite and the hematite in a phenolic resin binder. The particles were subjected to classification by a multi-division classifier ("Elbow Jet Labo EJ-L-3", mfd. by Nittetsu Kogyo K.K.) to remove a fine powder fraction. The resultant magnetic carrier core showed a number-average particle size (D1) of 40 μm and a percentage (cumulative) by number of particles having sizes of at most a half of D1 (=20 μm) (denoted hereinafter by "ND½%") of 5.7% N (% N represents a percent by number). The magnetic carrier core showed a resistivity (Rs) of $7.3\times10^{12}$ ohm.cm.

The magnetic carrier core particles were surface-coated with a thermosetting silicone resin in the following manner. So as to provide a coating resin rate of 1.2 wt. %, a 10 wt. % carrier coating resin solution in toluene was prepared. Into the solution, the carrier core particles were added, and the resultant mixture was heated under the action of a shearing force to vaporize the solvent to provide a coating on the carrier core. The resultant coated magnetic carrier particles were subjected to curing for 1 hour at 250° C., followed by disintegration and sieving through a 100-mesh sieve, to obtain coated magnetic carrier particles, which showed substantially the same number-average particle size and particle size distribution as the core particles, and also showed a sphericity (SF1) of 1.04.

The exposure density of metal oxide at the surface of the coated magnetic carrier particles was measured by the electron microscope and the image analyzer and found to be averagely 2.2 particles/$\mu m^2$.

The coated magnetic carrier showed a resistivity (Rs) of $9.2\times10^3$ ohm.cm and magnetic properties including a magnetization at 1 kilo-oersted ($\sigma_{1000}$)=57 emu/$cm^3$ (at a sample packing density=2.10 g/$cm^3$).

The properties of the coated magnetic carrier are inclusively shown in Table 1 appearing hereinafter.

On the other hand, toners were prepared in the following manner.

| Yellow toner | |
|---|---|
| Polyester resin (condensation product between bisphenol and fumaric acid) | 100 parts |
| C.I. Pigment Yellow (colorant) | 4.5 parts |
| Cr-complex salt of di-t-butyl-salicylic acid (charge control agent, pale) | 4 parts |

The materials were sufficiently preliminarily blended, melt-kneaded, cooled and coarsely crushed by a hammer mill into particle sizes of ca. 1–2 mm. Then, the product was further pulverized by an air jet-type pulverizer. The pulverizate was classified by an Elbow Jet classifier to recover a negatively chargeable yellow powder (non-magnetic yellow toner). The toner showed a weight-average particle size (D4) of 6.9 μm, a number-average particle size (D1) of 5.1 μm, a percentage by number of particles having sizes of at most a half of D1 (ND½%) of 7.3%N, and a percentage by volume of particles having sizes of at least 2×D4 (hereinafter denoted by "V2D4%") of 0%V (%V represents a percentage by volume).

100 wt. parts of the above yellow toner, and 1.0 wt. part of hydrophobized titanium oxide fine powder ($d_{av}$=0.02 μm) were blended with each other in a Henschel mixer to obtain a yellow toner carrying the titanium oxide fine powder externally added thereto. The yellow toner showed average particle sizes and particle size distribution substantially identical to those before the external addition. The toner showed a triboelectric charge (TC) of −36.5 μC/g when measured together with the above-prepared coated magnetic carrier (at a toner concentration of 5 wt. %).

| Magenta toner | |
|---|---|
| Polyester resin (same as for yellow toner) | 100 parts |
| C.I. Pigment Red | 4 parts |
| C.I. Basic Red 12 | 1 part |
| Cr-complex salt of di-t-butyl-salicylic acid | 4 parts |

From the above materials, a negatively chargeable magenta powder (non-magnetic magenta toner) was prepared in the same manner as the yellow toner. The magenta toner showed D4=6.4 μm, D1=4.9 μm, ND½%=6.7%N, and V2D4%=0%V.

100 wt. parts of the above magenta toner, and 1.0 wt. part of hydrophobized titanium oxide fine powder ($d_{av}$=0.02 μm) were blended with each other in a Henschel mixer to obtain a magenta toner carrying the titanium oxide fine powder externally added thereto. The magenta toner showed average particle sizes and particle size distribution substantially identical to those before the external addition. The toner showed a triboelectric charge (TC) of −34.9 μC/g when measured together with the above-prepared coated magnetic carrier.

| Cyan toner | |
|---|---|
| Polyester resin (same as for yellow toner) | 100 parts |
| Copper-phthalocyanine pigment | 5 parts |
| Cr-complex salt of di-t-butyl-salicylic acid | 4 parts |

From the above materials, a negatively chargeable cyan powder (non-magnetic cyan toner) was prepared in the same manner as the yellow toner. The cyan toner showed D4.=6.6 μm, D1=5.0 μm, ND½%=8.2%N, and V2D4%=0%V.

100 wt. parts of the above cyan toner, and 1.0 wt. part of hydrophobized titanium oxide fine powder ($d_{av}$=0.02 μm) were blended with each other in a Henschel mixer to obtain a cyan toner carrying the titanium oxide fine powder externally added thereto. The cyan toner showed average particle sizes and particle size distribution substantially identical to those before the external addition. The toner showed a triboelectric charge (TC) of −37.7 μC/g when measured together with the above-prepared coated magnetic carrier.

| Black toner | |
|---|---|
| Polyester resin (same as for yellow toner) | 100 parts |
| Carbon black (primary particle size = 60 nm) | 5 parts |
| Cr-complex salt of di-t-butyl-salicylic acid | 4 parts |

From the above materials, a negatively chargeable black powder (non-magnetic black toner) was prepared in the same manner as the yellow toner. The black toner showed D4=6.4 μm, D1=4.7 μm, ND½%=9.9%N, and V2D4%=0%V.

100 wt. parts of the above black toner, and 1.0 wt. part of hydrophobized titanium oxide fine powder ($d_{av}$=0.02 μm) were blended with each other in a Henschel mixer to obtain a black toner carrying the titanium oxide fine powder externally added thereto. The black toner showed average particle sizes and particle size distribution substantially identical to those before the external addition. The toner showed a triboelectric charge (TC) of −33.3 μC/g when measured together with the above-prepared coated magnetic carrier.

The above-prepared coated magnetic carrier was mixed with each of the above-prepared respective color toners to prepare four two-component type developers each having a toner concentration of 6.5 wt. %. The two-component type developers were charged in a full color laser copier ("CLC-500", mfd. by Canon K.K.) in a remodeled form so as to have developing devices each as shown in FIG. 1. Referring to FIG. 1, each developing device was designed to have a spacing A of 600 μm between a developer carrying member (developing sleeve) 1 and a developer-regulating member (magnetic blade) 2, and a gap B of 500 μm between the developing sleeve 1 and an electrostatic latent image-bearing member (photosensitive drum) 3. A developing nip C at that time was 5 mm. The developing sleeve 1 and the photosensitive drum 3 were driven at a peripheral speed ratio of 2.0:1. A developing sleeve S1 of the developing sleeve was designed to provide a magnetic field of 1 kilo-oersted, and the developing conditions included an alternating electric field of a rectangular waveform having a peak-to-peak voltage of 2000 volts and a frequency of 2200

Hz, a developing bias of −470 volts, a toner developing contrast (Vcont) of 350 volts, a fog removal voltage (Vback) of 80 volts, and a primary charge voltage on the photosensitive drum of −560 volts. Under the developing conditions, a digital latent image (spot diameter=64 μm) on the photosensitive drum 3 was developed by a reversal development mode.

As a result, the resultant images showed a high solid part image density (cyan toner) of 1.75, were free from roughening of dots, and showed no image disorder or fog at the image or non-image portion due to carrier attachment.

A continuous full-color image formation was performed on a large number of 30,000 sheets. Thereafter, an imaging test was performed similarly as the initial stage. The solid image of cyan toner showed a high density of 1.73, and the halftone showed a good reproducibility. Further, no fog or carrier attachment was observed. When the cyan developer after the continuous image formation was observed through a SEM (scanning electron microscope), the peeling of the coating resin on the carrier was not observed, but a good surface state similarly as that of the initial coated magnetic carrier surface.

The results are inclusively shown in Table 2 hereinafter.

EXAMPLE 2

| | |
|---|---|
| Phenol | 10 parts |
| Formalin (same as in Example 1) | 6 parts |
| Magnetite (same as in Example 1) | 44 parts |
| $\alpha$-$Fe_2O_3$ (same as in Example 1) | 44 parts |

The above materials were subjected to polymerization similarly as in Example 1 except for changing the amounts of the basic catalyst and water. The polymerizate particles were classified by Elbow Jet classifier to remove the fine powder fraction. The resultant carrier core showed D1=55 μm, ND½% =7.1%N, and Rs=$5.3\times10^{12}$ ohm.cm.

The core particles were coated with the same coating resin as in Example 1 but at a different coating rate of 0.8 wt. %.

The coated magnetic carrier particles showed substantially the same particle size and particle size distribution as before the coating, and a sphericity (SF1) of 1.06.

The exposure density of metal oxide at the surface of the coated magnetic carrier particles was measured similarly as in Example 1 and found to be 2.0 particles/$\mu m^2$.

The coated carrier particles showed Rs=$8.0\times10^{13}$ ohm.cm, and $\sigma_{1000}$=70 emu/$cm^3$ (packing density=2.11 g/$cm^3$).

The thus-obtained coated magnetic carrier was blended with the four color toners prepared in Example 1 to prepare four two-component type developers each having a toner concentration of 6%. The respective toners showed triboelectric charges of yellow: −36.2 μC/g, magenta: −34.7 μC/g, cyan: −37.9 μC/g and black: −32.8 μC/g, respectively, when measured at a toner concentration of 5 wt. %.

The developers were charged in the same image forming apparatus and used for development under the same developing conditions as in Example 1. As a result, similarly as in Example 1, images at the initial stage showed particularly excellent dot reproducibility and high resolution, and were free from fog or carrier attachment. As a result of a continuous full-color image formation on 30,000 sheets, the images thereafter showed almost similar image qualities as those at the initial stage. No carrier attachment was observed in the continuous image formation. The surface of the carrier after the continuous image formation was similarly good as that at the initial stage.

EXAMPLE 3

| | |
|---|---|
| Phenol | 10 parts |
| Formalin (same as in Example 1) | 6 parts |
| Magnetite (same as in Example 1) | 75 parts |
| $\alpha$-$Fe_2O_2$ (same as in Example 1) | 9 parts |

The above materials were subjected to polymerization similarly as in Example 1 except for changing the amounts of the basic catalyst and water. The polymerizate particles were classified by Elbow Jet classifier to remove the fine powder fraction. The resultant carrier core showed D1=32 μm, ND½% =9.2%N, and Rs=$2.4\times10^{12}$ ohm.cm.

The core particles were coated with the same coating resin as in Example 1 but at a different coating rate of 1.8 wt. %.

The coated magnetic carrier particles showed substantially the same particle size and particle size distribution as before the coating, and a sphericity (SF1) of 1.08.

The exposure density of metal oxide at the surface of the coated magnetic carrier particles was measured similarly as in Example 1 and found to be 2.0 particles/$\mu m^2$.

The coated carrier particles showed Rs=$2.1\times10^{13}$ ohm.cm, and $\sigma_{1000}$=127 emu/$cm^3$ (packing density=2.11 g/$cm^3$).

On the other hand, four colors of toners were prepared similarly as in Example 1 by using the same colorants but in different amounts of 6 parts for yellow, 5 parts and 1 part for magenta, 6.5 parts for cyan, and 6.5 parts for black, and by using different pulverization and classification conditions. The resultant color toners showed the following particle sizes and particle size distributions.

| | D4 (μm) | D1 (μm) | ND1/2% (% N) | V2D4% (% V) |
|---|---|---|---|---|
| Yellow toner | 5.0 | 3.6 | 12.2 | 0 |
| Magenta toner | 5.0 | 3.7 | 10.1 | 0 |
| Cyan toner | 5.2 | 3.7 | 10.6 | 0 |
| Black toner | 4.9 | 3.6 | 9.8 | 0 |

Each toner was blended with 2.0 wt. % of titanium oxide externally added thereto. The resultant four color toners were respectively blended with the above-prepared coated magnetic carrier to prepare four two-component type developers each having a toner concentration of 7%. The respective toners showed triboelectric charges of yellow: −39.1 μC/g, magenta: −37.3 μC/g, cyan: −41.7 μC/g and black: −37.0 μC/g.

The developers were charged in the same image forming apparatus and used for development under the same developing conditions as in Example 1. As a result, similarly as in Example 1, images at the initial stage showed particularly excellent dot reproducibility and high resolution, and were free from fog or carrier attachment. As a result of a continuous full-color image formation on 30,000 sheets, the images thereafter showed almost similar image qualities as those at the initial stage. No carrier attachment was observed in the continuous image formation.

EXAMPLE 4

| | |
|---|---|
| Phenol | 6.5 parts |
| Formalin (same as in Example 1) | 3.5 parts |
| Magnetite (same as in Example 1) | 81 parts |
| $Al_2O_3$ ($d_{av}$ 0.63 μm, Rs = $5 \times 10^{13}$ ohm.cm) | 9 parts |

The above materials were subjected to polymerization similarly as in Example 1. The polymerizate particles were classified by Elbow Jet classifier to remove the fine powder fraction. The resultant carrier core showed D1=28 μm, ND½%=12.4%N, and Rs=$4.2\times10^{11}$ ohm.cm.

The core particles were coated with a styrene/2-ethylhexyl methacrylate (50/50) copolymer and dried at 150° C. for 1 hour to provide a coating rate of 2.2 wt. %.

The coated magnetic carrier particles showed substantially the same particle size and particle size distribution as before the coating, and a sphericity (SF1) of 1.09.

The exposure density of metal oxide at the surface of the coated magnetic carrier particles was measured similarly as in Example 1 and found to be 3.0 particles/$\mu m^2$.

The coated carrier particles showed Rs=$5.2\times10^{13}$ ohm.cm, and $\sigma_{1000}$=140 emu/$cm^3$ (packing density=2.41 g/$cm^3$).

The thus-obtained coated magnetic carrier was blended with the four color toners prepared in Example 3 to prepare four two-component type developers each having a toner concentration of 9%. The respective toners showed triboelectric charges of yellow: −37.5 μC/g, magenta: −35.3 μC/g, cyan: −39.1 μC/g and black: −35.8 μC/g.

The developers were charged in the same image forming apparatus and used for development under the same developing conditions as in Example 1 except that the spacing A between the developing sleeve 1 and the magnetic blade 2 was changed to 750 μm. As a result, high resolution images with a particularly excellent dot reproducibility were obtained without fog or carrier attachment. As a result of a continuous full-color image formation on 30,000 sheets, the images thereafter showed almost similar image qualities as those at the initial stage. No carrier attachment was observed in the continuous image formation.

EXAMPLE 5

| | |
|---|---|
| Melamine | 25 parts |
| Formalin (same as in Example 1) | 15 parts |
| Magnetite (same as in Example 1) | 60 parts |

The above materials were subjected to polymerization similarly as in Example 1 except for further using 1 part of PVA (dispersion stabilizer). The polymerizate particles were classified by Elbow Jet classifier to remove the fine powder fraction. The resultant carrier core showed D1=48 μm, ND½% =6.6%N, and Rs=$7.7\times10^{10}$ ohm.cm.

The core particles were coated with the same coating resin as in Example 1 but at a different coating rate of 1.0 wt. %.

The coated magnetic carrier particles showed substantially the same particle size and particle size distribution a before the coating, and a sphericity (SF1) of 1.15.

The exposure density of metal oxide at the surface of the coated magnetic carrier particles was measured similarly as in Example 1 and found to be 1.4 particles/$\mu m^2$.

The coated carrier particles showed Rs=$1.5\times10^{13}$ ohm.cm, and $\sigma_{1000}$=49 emu/$cm^3$ (packing density=1.32 g/$cm^3$).

The thus-obtained coated magnetic carrier was blended with the four color toners prepared in Example 1 to prepare four two-component type developers each having a toner concentration of 6.5%. The respective toners showed triboelectric charges of yellow: −33.4 μC/g, magenta: −34.7 μC/g, cyan: −30.4 μC/g and black: −28.6 μC/g.

The developers were charged in the same image forming apparatus and used for development under the same developing conditions as in Example 1. As a result, similarly as in Example 1, images at the initial stage showed particularly excellent dot reproducibility and high resolution, and were free from fog or carrier attachment. As a result of a continuous full-color image formation on 30,000 sheets, the images thereafter showed almost similar image qualities as those at the initial stage. No carrier attachment was observed in the continuous image formation. The surface of the carrier after the continuous image formation was similarly good as that at the initial stage.

EXAMPLE 6

| | |
|---|---|
| Phenol | 6.5 parts |
| Formalin (same as in Example 1) | 3.5 parts |
| Magnetite (same as in Example 1) | 54 parts |
| $CuO_{0.17}$ $ZnO_{0.23}$ $F_2O_{3\ 0.60}$ ($d_{av}$ = 0.78 μm, Rs = $8 \times 10^8$ ohm.cm) | 36 parts |

The above materials were subjected to polymerization similarly as in Example 1. The polymerizate particles were classified by Elbow Jet classifier to remove the fine powder fraction. The resultant carrier core showed D1=34 μm, ND½%=4.4%N, and Rs=$6.7\times10^{12}$ ohm.cm.

The core particles were coated with a 5 wt. %-fluorine-containing resin solution in toluene otherwise similarly as in Example 1 to provide a coating rate of 1.0 wt. %.

The coated magnetic carrier particles showed substantially the same particle size and particle size distribution as before the coating, and a sphericity (SF1) of 1.09.

The exposure density of metal oxide at the surface of the coated magnetic carrier particles was measured similarly as in Example 1 and found to be 2.0 particles/$\mu m^2$.

The coated carrier particles showed Rs=$7.2\times10^{13}$ ohm.cm, and $\sigma_{1000}$=120 emu/$cm^3$ (packing density=2.44 g/$cm^3$).

The thus-obtained coated magnetic carrier was blended with the four color toners prepared in Example 3 to prepare four two-component type developers each having a toner concentration of 7%. The respective toners showed triboelectric charges of yellow: −34.4 μC/g, magenta: −31.2 μC/g, cyan: −38.8 μC/g and black: −34.5 μC/g.

The developers were charged in the same image forming apparatus and used for development under the same developing conditions as in Example 1. As a result, good image qualities were obtained both at the initial stage and after 30,000 of continuous image formation similarly as in Example 1. Particularly good quality was obtained regarding freeness from roughening at halftone part both before and after the continuous image formation. This might be attributable to a low-surface energy of the fluorine-containing coating resin resulting in good releasability of toner. The carrier surfaces after the continuous image formation were good similarly as those at the initial stage.

EXAMPLE 7

| | |
|---|---|
| Melamine | 10 parts |
| Formalin (same as in Example 1) | 6 parts |
| $CuO_{0.25}$ $ZnO_{0.25}$ $Fe_2O_3$ 0.50 ($d_{av}$ = 0.25 μm, Rs = 7 × $10^8$ ohm.cm) | 59 parts |
| $Al_2O_3$ ($d_{av}$ = 0.63 μm, Rs = 5 × $10^{13}$ ohm.cm) | 25 parts |

The above materials were subjected to polymerization in a basic liquid medium similarly as in Example 1. The polymerizate particles were classified by Elbow Jet classifier to remove the fine powder fraction. The resultant carrier core showed D1 =48 μm, ND½%=4.5%N, and Rs=5.4×$10^{13}$ ohm.cm.

The core particles were coated with the same coating resin as in Example 6 in a similar manner.

The coated magnetic carrier particles showed substantially the same particle size and particle size distribution as before the coating, and a sphericity (SF1) of 1.08.

The exposure density of metal oxide at the surface of the coated magnetic carrier particles was measured similarly as in Example 1 and found to be 2.0 particles/μm$^2$.

The coated carrier particles showed Rs=1.1×$10^{14}$ ohm.cm, and $\sigma_{1000}$=87 emu/cm$^3$ (packing density=2.35 g/cm$^3$).

The thus-obtained coated magnetic carrier was blended with the four color toners prepared in Example 1 to prepare four two-component type developers each having a toner concentration of 6%. The respective toners showed triboelectric charges of yellow: −27.3 μC/g, magenta: −25.5 μC/g, cyan: −26.6 μC/g and black: −25.9 μC/g.

The developers were charged in the same image forming apparatus and used for development under the same developing conditions as in Example 1. As a result, good image qualities were obtained both at the initial stage and after the continuous image formation similarly as in Example 1. Good results were obtained regarding fog and carrier attachment both before and after the continuous image formation. The carrier surfaces after the continuous image formation were similar to those before the continuous image formation.

EXAMPLE 8

| | |
|---|---|
| Styrene/isobutyl acrylate (85/15 by weight) copolymer | 20 parts |
| Magnetite (same as in Example 1) | 70 parts |
| γ-$Fe_2O_3$ ($d_{av}$ = 0.80 μm, Rs = 2 × $10^8$ ohm.cm) | 10 parts |

The above materials were sufficiently preliminarily blended in a Henschel mixer, melt-knead two times by a 3-roll mill, cooled, coarsely crushed to ca. 2 mm by a hammer mill, and pulverized to a particle size of ca. 33 μm by an air-jet pulverizer. The pulverizate was then charged in Mechanomill MM-10 (available from Okada Seiko K.K.) to be mechanically spherized.

The spherized pulverizate particles were further classified to obtain a magnetic material-dispersed resinous carrier core. The carrier core showed D1=34 μm, ND½%=12.2%N, and Rs=2.7×$10^{12}$ ohm.cm. Then, the carrier core was introduced into a fluidized bed coating apparatus and coated with a coating liquid containing 5% of the coating resin used in Example 4, followed by drying at 60° C. for 1 hour, to provide a coating rate of 2.0%.

The coated magnetic carrier particles showed substantially the same particle size and particle size distribution as before the coating, and a sphericity (SF1) of 1.19.

The exposure density of metal oxide at the surface of the coated magnetic carrier particles was measured similarly as in Example 1 and found to be 2.2 particles/μm$^2$.

The coated carrier particles showed Rs=5.1×$10^{13}$ ohm.cm, and $\sigma_{1000}$=80 emu/cm$^3$ (packing density=1.90 g/cm$^3$).

The thus-obtained coated magnetic carrier was blended with the four color toners prepared in Example 3 to prepare four two-component type developers each having a toner concentration of 7%. The respective toners showed triboelectric charges of yellow: −38.8 μC/g, magenta: −37.1 μC/g, cyan: −40.2 μC/g and black: −37.3 μC/g.

The developers were charged in the same image forming apparatus and used for development under the same developing conditions as in Example 1. As a result, good image qualities were obtained both at the initial stage and after the continuous image formation similarly as in Example 1. Good results were obtained regarding fog and carrier attachment both before and after the continuous image formation. The carrier surfaces after the continuous image formation were similar to those before the continuous image formation similarly as in Example 1. The carrier surfaces after the continuous image formation were similar to those before the continuous image formation.

EXAMPLE 9

Magnetite particles having a number-average particle size of 49 μm were heated at 800° C. in air for 2 hours. The resultant particles showed a resistivity (Rs) of 2.0×$10^{10}$ ohm.cm. The particles were surface coated similarly as in Example 1.

The coated carrier particles were then classified by Elbow Jet classifier to remove a fine powder fraction, thereby obtaining coated magnetic carrier particles. The carrier particles showed D1=48 μm, ND½%=11.5 %N, Rs=6.7×$10^{12}$ ohm.cm, a sphericity (SF1) of 1.20 and $\sigma_{1000}$=109 emu/cm$^3$ (packing density=3.30 g/cm$^3$).

The thus-obtained coated magnetic carrier was blended with the four color toners prepared in Example 1 to prepare four two-component type developers each having a toner concentration of 6%. The respective toners showed triboelectric charges of yellow: −27.2 μC/g, magenta: −25.1 μC/g, cyan: −27.9 μC/g and black: −25.5 μC/g.

The developers were charged in the same image forming apparatus and used for development under the same developing conditions as in Example 1. As a result, good results were obtained with respect image qualities both at the initial stage and after the continuous image formation.

COMPARATIVE EXAMPLE 1

$Fe_2O_3$, CuO and ZnO were weighed so as to provide a composition of 50 mol. %, 27 mol. % and 23 mol. %, respectively, and were mixed with each other by a ball mill. The mixture was calcined at 1000° C., and pulverized by a ball mill. The resultant powder in 100 parts, 0.5 part of polysodium methacrylate and water were mixed with each other in a wet ball mill to form a slurry. The slurry was formed into particles by a spray drier. The particles were then sintered at 1200° C. to provide carrier core particles, which showed Rs=4.0×$10^8$ ohm.cm.

The carrier was surface-coated with a resin in the same manner as in Example 1. The resultant carrier particles showed D1=47 μm, ND½=23.1%N, Rs=1.1×10$^{10}$ ohm.cm, a sphericity (SF1)=1.24 and $\sigma_{1000}$=206 emu/cm$^3$ (packing density=3.46 g/cm$^3$).

The thus-obtained carrier was blended with the four color toners prepared in Example 1 to prepare four two-component type developers each having a toner concentration of 6%. The respective toners showed triboelectric charges of yellow: −25.5 μC/g, magenta: −23.7 μC/g, cyan: −26.1 μC/g and black: −24.3 μc/g.

The developers were charged in the same image forming apparatus and used for development under the same developing conditions as in Example 1 except for changing the spacing & between the developing sleeve 1 and the magnetic blade 2 to 850 μm. As a result, the resultant images showed a high solid part image density but were inferior with respect to roughening of dots and halftone reproducibility. Further, the non-image part provided a rough feel due to toner attachment, which was found to be caused by fine carrier powder fraction of at most 20 μm. Toner fog was recognized. Further, as a result of observation of the carrier after a continuous image formation in a similar manner as in Example 1, melt-sticking of toner was observed on the carrier. Images formed after the continuous image formation were accompanied with further infer/or roughening of halftone part and further inferior fog.

COMPARATIVE EXAMPLE 2

| | |
|---|---|
| Styrene/isobutyl acrylate (90/10) copolymer | 40 parts |
| Magnetite (same as in Example 1) | 60 parts |

The above materials were melt-kneaded, pulverized and spherized to obtain a magnetic material-dispersed resinous carrier core. The carrier core was used as it was as a carrier, i.e., without classification or coating. The carrier showed Rs=9.3×10$^{12}$ ohm.cm, D1=53 μm, ND½%=22.0%N, and a sphericity (SF1)=1.16.

The exposure density of magnetic carrier at the surface of the carrier was measured similarly as in Example 1 and found to be 1.9 particles/μm$^2$.

The carrier showed $\sigma_{1000}$=50 emu/cm$^3$ (packing density=1.32 g/cm$^3$).

The thus-obtained carrier was blended with the four color toners prepared in Example 1 to prepare four two-component type developers each having a toner concentration of 6%. The respective toners showed triboelectric charges of yellow: −29.7 μC/g, magenta: −25.7 μC/g, cyan: −28.7 μC/g and black: −26.8 μC/g.

The developers were charged in the same image forming apparatus and used for development under the same developing conditions as in Example 1. As a result, the resultant images at the initial stage showed somewhat inferior roughening of halftone images, and carrier attachment was observed.

COMPARATIVE EXAMPLE 3

| | |
|---|---|
| Phenol | 6.5 parts |
| Formalin (same as in Example 1) | 3.5 parts |
| Magnetite (same as in Example 1) | 45 parts |
| Magnetite ($d_{av}$ = 0.66 μm, Rs = 5 × 10$^5$ ohm.cm) | 45 parts |

From the above materials, polymerizate particles were obtained and then classified similarly as in Example 1 to obtain a magnetic material-dispersed resinous carrier core. The resultant carrier core showed D1=45 μm, ND½%=6.8 %N, and Rs=3.5×10$^8$ ohm.cm.

The core particles were coated with the same coating resin as in Example 1 but at a different coating rate of 1.0 wt. %.

The coated magnetic carrier particles showed substantially the same particle size and particle size distribution a before the coating, and a sphericity (SF1) of 1.06.

The exposure density of metal oxide at the surface of the coated magnetic carrier particles was measured similarly as in Example 1 and found to be 1.4 particles/μm$^2$.

The coated carrier particles showed Rs=2.2×10$^{10}$ ohm.cm, and $\sigma_{1000}$=166 emu/cm$^3$ (packing density=2.43 g/cm$^3$).

The thus-obtained coated magnetic carrier was blended with the four color toners prepared in Example 1 to prepare four two-component type developers each having a toner concentration of 6.5%. The respective toners showed triboelectric charges of yellow: −35.8 μC/g, magenta: −33.4 μC/g, cyan: −34.9 μC/g and black: −32.1 μC/g.

The developers were charged in the same image forming apparatus and used for development under the same developing conditions as in Example 1. As a result, the carrier attachment prevention was good, but halftone images were accompanied with some disorder of dot shape and recognizable toughening.

COMPARATIVE EXAMPLE 4

The carrier was the same coated carrier as in Example 1. Four color toners were prepared from the same composition and in the same manner as in Example 1 but under different pulverization and classification conditions. The resultant color toners showed the following particle sizes and particle size distributions.

| | D4 (μm) | D1 (μm) | ND1/2% (% N) | V2D4% (% V) |
|---|---|---|---|---|
| Yellow toner | 6.7 | 4.3 | 25.5 | 0.1 |
| Magenta toner | 6.5 | 4.2 | 21.5 | 0 |
| Cyan toner | 6.8 | 4.5 | 23.6 | 0.1 |
| Black toner | 6.7 | 4.3 | 23.8 | 0.1 |

Each toner was blended with 0.8 wt. % of titanium oxide externally added thereto similarly as in Example 1. The resultant four color toners were respectively blended with the above coated magnetic carrier to prepare four two-component type developers each having a toner concentration of 6.5%. The respective toners showed triboelectric charges of yellow: −38.8 μC/g, magenta: −37.5 μC/g, cyan: −39.1 μC/g and black: −38.8 μC/g.

The developers were charged in the same image forming apparatus and used for development under the same developing conditions as in Example 1. As a result, halftone images showed poor dot reproducibility and roughening, and non-image parts were accompanied with fog. Further, after the continuous image formation, the toners showed a change in particle size distribution and resultant in roughening of halftone images and fog while the image density was increased.

The above-mentioned characteristic properties of carriers and toners are summarized in Table 1 below, and the results of evaluation are summarized in Table 2 appearing hereinafter, for which the evaluation standards are inclusively shown after Table 2.

TABLE 1

| | Carrier | | | | | Toner*,** | | | | | | | |
|---|---|---|---|---|---|---|---|---|---|---|---|---|---|
| | | | Rs | | | D1 (μm) | | D4 (μm) | | ND½% (% N) | | V2D4% (% V) | |
| | D1 (μm) | ND½ (% N) | Core (Ω · cm) | Carrier (Ω · cm) | $\sigma_{1000}$ (emu/cm³) | Y C | M B | Y C | M B | Y C | M B | Y C | M B |
| Ex. 1 | 40 | 5.7 | $7.3 \times 10^{12}$ | $9.2 \times 10^{13}$ | 57 | 5.1 | 4.9 | 6.9 | 6.4 | 7.3 | 6.7 | 0 | 0 |
| | | | | | | 5 | 4.7 | 6.6 | 6.4 | 8.2 | 9.9 | 0 | 0 |
| Ex. 2 | 55 | 7.1 | $5.3 \times 10^{12}$ | $8.0 \times 10^{13}$ | 70 | S.A. | Ex.1 | S.A. | Ex.1 | S.A. | Ex.1 | S.A. | Ex.1 |
| Ex. 3 | 32 | 9.2 | $2.4 \times 10^{12}$ | $2.1 \times 10^{13}$ | 127 | 3.6 | 3.7 | 5 | 5 | 12.2 | 10.1 | 0 | 0 |
| | | | | | | 3.7 | 3.6 | 5.2 | 4.9 | 10.6 | 9.8 | 0 | 0 |
| Ex. 4 | 28 | 12.4 | $4.2 \times 10^{11}$ | $5.2 \times 10^{13}$ | 140 | S.A. | Ex.3 | S.A. | Ex.3 | S.A. | Ex.3 | S.A. | Ex.3 |
| Ex. 5 | 48 | 6.6 | $7.7 \times 10^{10}$ | $1.5 \times 10^{13}$ | 49 | S.A. | Ex.1 | S.A. | Ex.1 | S.A. | Ex.1 | S.A. | Ex.1 |
| Ex. 6 | 34 | 4.4 | $6.7 \times 10^{12}$ | $7.2 \times 10^{13}$ | 120 | S.A. | Ex.3 | S.A. | Ex.3 | S.A. | Ex.3 | S.A. | Ex.3 |
| Ex. 7 | 48 | 4.5 | $5.4 \times 10^{13}$ | $1.1 \times 10^{14}$ | 87 | S.A. | Ex.1 | S.A. | Ex.1 | S.A. | Ex.1 | S.A. | Ex.1 |
| Ex. 8 | 34 | 12.2 | $2.7 \times 10^{12}$ | $5.1 \times 10^{13}$ | 80 | S.A. | Ex.3 | S.A. | Ex.3 | S.A. | Ex.3 | S.A. | Ex.3 |
| Ex. 9 | 51 | 11.5 | $2.0 \times 10^{10}$ | $6.7 \times 10^{12}$ | 109 | S.A. | Ex.1 | S.A. | Ex.1 | S.A. | Ex.1 | S.A. | Ex.1 |
| Comp. Ex. 1 | 47 | 23.1 | $4.0 \times 10^{8}$ | $1.1 \times 10^{10}$ | 206 | S.A. | Ex.1 | S.A. | Ex.1 | S.A. | Ex.1 | S.A. | Ex.1 |
| Comp. Ex. 2 | 53 | 22 | $9.3 \times 10^{12}$ | $9.3 \times 10^{12}$ | 50 | S.A. | Ex.1 | S.A. | Ex.1 | S.A. | Ex.1 | S.A. | Ex. 1 |
| Comp. Ex. 3 | 45 | 6.8 | $3.5 \times 10^{8}$ | $2.2 \times 10^{10}$ | 166 | S.A. | Ex.1 | S.A. | Ex.1 | S.A. | Ex.1 | S.A. | Ex.1 |
| Comp. Ex. 4 | | | S.A. Ex. 1 | | | 4.3 | 4.2 | 6.7 | 6.5 | 25.5 | 21.5 | 0.1 | 0 |
| | | | | | | 4.5 | 4.3 | 6.8 | 6.7 | 23.6 | 23.8 | 0.1 | 0.1 |

*Y: yellow toner, M: magenta toner, C: cyan toner, B: black toner
**S.A. Ex.1: The same as in Example 1.
S.A. Ex.3: The same as in Example 3.

TABLE 2

| | Images at initial stage | | | | | Images after 30,000 sheets | | | |
|---|---|---|---|---|---|---|---|---|---|
| | Nip C (mm) | Solid* cyan I.D. | Halftone roughening | Carrier attachment | Fog | Solid cyan I.C. | Halftone roughening | Carrier attachment | Fog |
| Ex. 1 | 5 | 1.75 | ⊙ | ○ | ⊙ | 1.73 | ⊙ | ○ | ⊙ |
| 2 | 5 | 1.7 | ⊙ | ○ | ⊙ | 1.7 | ⊙ | ○ | ⊙ |
| 3 | 6.5 | 1.71 | ⊙ | ○ | ○ | 1.69 | ⊙ | ○ | ○ |
| 4 | 6 | 1.68 | ⊙ | ○ | ○ | 1.65 | ⊙ | ○ | ○ |
| 5 | 5 | 1.66 | ⊙ | ○ | ⊙ | 1.66 | ⊙ | ○ | ⊙ |
| 6 | 5.5 | 1.68 | ○ | ○ | ○ | 1.65 | ○ | ○ | ○ |
| 7 | 5 | 1.73 | ⊙ | ○ | ⊙ | 1.7 | ⊙ | ○ | ⊙ |
| 8 | 6 | 1.68 | ○ | ○ | ○ | 1.64 | ○ | ○ | ○ |
| 9 | 5.5 | 1.69 | ○ | ○ | ○ | 1.64 | ○ | ○ | ○ |
| Comp.Ex.1 | 6.5 | 1.67 | x | x | x | 1.6 | x | ○ | x |
| 2 | 5 | 1.63 | Δ | x | ○ | 1.61 | Δ | Δ | ○ |
| 3 | 5.5 | 1.6 | Δx | ○ | Δ | 1.6 | Δx | ○ | Δ |
| 4 | 5 | 1.67 | ΔX | ○ | x | 1.71 | x | ○ | x |

*Solid cyan I.D.: Image density of a solid cyan image portion.
⊙: Excellent, ○: good, : Fair, x: Somewhat inferior, x: Poor

[Notes to Table 2]

Solid cyan I.D.

The image density of a solid cyan image portion was measured by a Macbeth densitometer ("RD-Type" using SPI filter, mfd. by Macbeth Co.), as a relative density of an image printed on a sheet of plain paper.

Halftone roughening

The degree of roughening of halftone image portion was evaluated with eyes with reference to an original image and standard samples.

Carrier attachment

After formation of solid white image, a transparent adhesive tape was applied onto a region of 5 cm×5 cm between the developing region and the cleaner region on the photosensitive drum to recover magnetic carrier particles attached to the photosensitive drum. The number of attached carrier particles attached in the region of 5 cm×5 cm was counted, and evaluation was performed based on the number of attached carrier particles per cm² calculated therefrom according to the following standard:

⊙ (excellent): less than 10 particles/cm² o (good): 10 to less than 20 particles/cm²

Δ (fair): 20 to less than 50 particles/cm²

Δx (somewhat inferior): 50 to less than 10 particles/cm² x (poor): 100 particles/cm² or more

Fog

The average reflection rate Dr (%) of the sheet of plain paper before printing was measured by a reflectometer ("REFLECTOMETER MODEL TC-6DS" mfd. by Tokyo Denshoku K.K.). On the other hand, a solid white image was printed onto the sheet of plain paper, and the reflection rate Ds (%) of the solid white image was measured by the reflectometer. Fog (%) was calculated by the following equation:

$$Fog\ (\%)=Dr(\%)-Ds\ (\%)$$

The evaluation was performed according to the following standard:

ⓞ (excellent): below 1.0%, o (good): 1.0–below 1.5%,

Δ (fair): 1.5–below 2.0%,

Δx (somewhat inferior): 2.0–below 3.0%, x (poor): 3% or more.

What is claimed is:

1. A two-component type developer for developing an electrostatic image, comprising: at least a non-magnetic toner and a magnetic carrier; wherein the non-magnetic toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/cm$^3$.

2. The developer according to claim 1, wherein the magnetic carrier is a resin-coated magnetic carrier which comprises core particles comprising a binder resin and a metal oxide, and a resin coating the core particles.

3. The developer according to claim 2, wherein the core particles of the resin-coated magnetic carrier contain 50–99 wt. % of the metal oxide.

4. The developer according to claim 2 or 3, wherein the resin-coated magnetic carrier contains on the average at most 5 magnetic carrier particles/μm$^2$ exposed to the surface thereof.

5. The developer according to claim 2, wherein the binder resin comprises a thermosetting resin.

6. The developer according to claim 2 or 5, wherein the core particles have been prepared by polymerizing a polymerizable monomer in the presence of a metal oxide.

7. The developer according to claim 1, wherein (a) the magnetic carrier comprises resinous magnetic carrier core particles comprising at least two metal oxides and a binder resin, (b) the core particles contain 50–99 wt. % of the metal oxides in total, (c) the metal oxides include at least one ferromagnetic and at least one metal oxide having a higher resistivity than the ferromagnetic, (d) the ferromagnetic has a number-average particle size ra, and the higher-resistivity metal oxide has a number-average particle size rb satisfying rb/ra>1.0, and (e) the ferromagnetic occupies 30–95 wt. % of the total metal oxides.

8. The developer according to claim 1, wherein the non-magnetic toner has a weight-average particle size of 1–6 μm, and the magnetic carrier has a number-average particle size of 5–35 μm.

9. The developer according to claim 8, wherein the magnetic carrier comprises core particles containing 50–95 wt. % of a ferromagnetic metal oxide, and the magnetic carrier has a magnetization at 1 kilo-oersted of 100–150 emu/cm$^3$.

10. The developer according to claim 1, wherein the non-magnetic toner has a weight-average particle size of 3–8 μm, and the magnetic carrier has a number-average particle size of 35–80 μm.

11. The developer according to claim 10, wherein the magnetic carrier comprises core particles containing 30–60 wt. % of a ferromagnetic metal oxide, and the magnetic carrier has a magnetization at 1 kilo-oersted of 30–100 emu/cm$^3$.

12. The developer according to claim 7, wherein the ferromagnetic comprises magnetite.

13. The developer according to claim 7, wherein the higher-resistivity metal oxide comprises hematite.

14. The developer according to claim 7, wherein the ferromagnetic comprises magnetite, and the higher-resistivity metal oxide comprises hematite.

15. The developer according to claim 1, further comprising inorganic fine powder having an average particle size of at most 0.2 μm as an external additive to the toner.

16. The developer according to claim 1, further comprising organic fine powder having an average particle size of at most 0.2 μm as an external additive to the toner.

17. The developer according to claim 1, further comprising inorganic fine powder having an average particle size of at most 0.2 μm and organic fine powder having an average particle size of at most 0.2 μm as external additives to the toner.

18. The developer according to claim 16 to 17, wherein the organic fine powder comprises fine particles of a resin.

19. A developing method for developing an electrostatic image, comprising:

(A) carrying a two-component type developer by a developer-carrying member enclosing therein a magnetic field generating means, said two-component type developer comprising a non-magnetic toner and a magnetic carrier; wherein the non-magnetic toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/cm$^3$, (B) forming a magnetic brush of the two-component type developer on the developer-carrying member, (C) causing the magnetic brush to contact a latent image-bearing member, and (D) developing an electrostatic image on the latent image-bearing member to form a toner image while applying an alternating electric field to the developer-carrying member.

20. The developing method according to claim 19, wherein the electrostatic image comprises a digital image.

21. The developing method according to claim 19 or 20, wherein the electrostatic image is developed by a reversal development mode.

22. The developing method according to claim 19, wherein the magnetic brush contacts the latent image-bearing member with a developing nip of 3–8 mm.

23. The developing method according to claim 22, wherein the magnetic carrier is a resin-coated magnetic carrier which comprises core particles comprising a binder resin and a metal oxide, and a resin coating the core particles.

24. The developing method according to claim 23, wherein the core particles of the resin-coated magnetic carrier contain 50–99 wt. % of the metal oxide.

25. The developing method according to claim 23 or 24, wherein the resin-coated magnetic carrier contains on the average at most magnetic carrier particles 1 $\mu m^2$ exposed to the surface thereof.

26. The developing method according to claim 23, wherein the binder resin comprises a thermosetting resin.

27. The developing method according to claim 23 or 26, wherein the core particles have been prepared by polymerizing a polymerizable monomer in the presence of a metal oxide.

28. The developing method according to claim 19, wherein (a) the magnetic carrier comprises resinous magnetic carrier core particles comprising at least two metal oxides and a binder resin, (b) the core particles contain 50–99 wt. % of the metal oxides in total, (c) the metal oxides include at least one ferromagnetic and at least one metal oxide having a higher resistivity than the ferromagnetic, (d) the ferromagnetic has a number-average particle size ra, and the higher-resistivity metal oxide has a number-average particle size rb satisfying rb/ra>1.0, and (e) the ferromagnetic occupies 30–95 wt. % of the total metal oxides.

29. The developing method according to claim 19, wherein the non-magnetic toner has a weight-average particle size of 1–6 μm, and the magnetic carrier has a number-average particle size of 5–35 μm.

30. The developing method according to claim 29, wherein the magnetic carrier comprises core particles containing 50–95 wt. % of a ferromagnetic metal oxide, and the magnetic carrier has a magnetization at 1 kilo-oersted of 100–150 emu/$cm^3$.

31. The developing method according to claim 19, wherein the non-magnetic toner has a weight-average particle size of 3–8 μm, and the magnetic carrier has a number-average particle size of 35–80 μm.

32. The developing method according to claim 31, wherein the magnetic carrier comprises core particles containing 30–60 wt. % of a ferromagnetic metal oxide, and the magnetic carrier has a magnetization at 1 kilo-oersted of 30–100 emu/$cm^3$.

33. The developing method according to claim 28, wherein the ferromagnetic comprises magnetite.

34. The developing method according to claim 28, wherein the higher-resistivity metal oxide comprises hematite.

35. The developing method according to claim 28, wherein the ferromagnetic comprises magnetite, and the higher-resistivity metal oxide comprises hematite.

36. The developing method according to claim 19, wherein the developer further comprises inorganic fine powder having an average particle size of at most 0.2 μm as an external additive to the toner.

37. The developing method according to claim 19, wherein the developer further comprises organic fine powder having an average particle size of at most 0.2 μm as an external additive to the toner.

38. The developing method according to claim 19, wherein the developer further comprises inorganic fine powder having an average particle size of at most 0.2 μm and organic fine powder having an average particle size of at most 0.2 μm as external additives to the toner.

39. The developing method according to claim 37 to 38, wherein the organic fine powder comprises fine particles of a resin.

40. An image forming method, comprising:

(A1) carrying a two-component type developer by a developer-carrying member enclosing therein a magnetic field generating means, said two-component type developer comprising a non-magnetic magenta toner and a magnetic carrier; wherein the non-magnetic magenta toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/$cm^3$, (B1) forming a magnetic brush of the two-component type developer on the developer-carrying member, (C1) causing the magnetic brush to contact a latent image-bearing member, and (D1) developing an electrostatic image on the latent image-bearing member to form a magenta toner image while applying an alternating electric field to the developer-carrying member;

(A2) carrying a two-component type developer by a developer-carrying member enclosing therein a magnetic field generating means, said two-component type developer comprising a non-magnetic cyan toner and a magnetic carrier; wherein the non-magnetic cyan toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/$cm^3$, (B2) forming a magnetic brush of the two-component type developer on the developer-carrying member, (C2) causing the magnetic brush to contact a latent image-bearing member, and (D2) developing an electrostatic image on the latent image-bearing member to form a cyan toner image while applying an alternating electric field to the developer-carrying member;

(A3) carrying a two-component type developer by a developer-carrying member enclosing therein a magnetic field generating means, said two-component type developer comprising a non-magnetic yellow toner and a magnetic carrier; wherein the non-magnetic yellow toner has a weight-average particle size D4 of 1–10 μm, a number-average particle size D1 and such a particle size distribution that particles having size of at most D½ occupy at most 20% by number and particles having sizes of at least D4×2 occupy at most 10% by volume, and the magnetic carrier has a number-average particle size of 1–100 μm and contains at most 20% by number of particles having sizes in the range of at most a half of the number-average particle size, the magnetic carrier has a resistivity of at least $1\times10^{12}$ ohm.cm and has a core having a resistivity of at least $1\times10^{10}$ ohm.cm, and the magnetic carrier has a magnetization at 1 kilo-oersted of 30–150 emu/cm$^3$, (B3) forming a magnetic brush of the two-component type developer on the developer-carrying member, (C3) causing the magnetic brush to contact a latent image-bearing member, and (D3) developing an electrostatic image on the latent image-bearing member to form a yellow toner image while applying an alternating electric field to the developer-carrying member;

(E) forming a full color image with at least the above-formed magenta toner image, cyan toner image and yellow toner image.

41. The image forming method according to claim 40, wherein the electrostatic image comprises a digital image.

42. The image forming method according to claim 40 or 41, wherein the electrostatic image is developed by a reversal development mode.

43. The image forming method according to claim 40, wherein the magnetic brush contacts the latent image-bearing member with a developing nip of 3–8 mm.

44. The image forming method according to claim 40, wherein the magnetic carrier is a resin-coated magnetic carrier which comprises core particles comprising a binder resin and a metal oxide, and a resin coating the core particles.

45. The image forming method according to claim 44, wherein the core particles of the resin-coated magnetic carrier contain 50–99 wt. % of the metal oxide.

46. The image forming method according to claim 44 or 45, wherein the resin-coated magnetic carrier contains on the average at most 5 magnetic carrier particles/μm$^2$ exposed to the surface thereof.

47. The image forming method according to claim 44, wherein the binder comprises a thermosetting resin.

48. The image forming method according to claim 44 or 45, wherein the core particles have been prepared by polymerizing a polymerizable monomer in the presence of a metal oxide.

49. The image forming method according to claim 40, wherein (a) the magnetic carrier comprises resinous magnetic carrier core particles comprising at least two metal oxides and a binder resin, (b) the core particles contain 50–99 wt. % of the metal oxides in total, (c) the metal oxides include at least one ferromagnetic and at least one metal oxide having a higher resistivity than the ferromagnetic, (d) the ferromagnetic has a number-average particle size ra, and the higher-resistivity metal oxide has a number-average particle size rb satisfying rb/ra>1.0, and (e) the ferromagnetic occupies 30–95 wt. % of the total metal oxides.

50. The image forming method according to claim 40, wherein the non-magnetic toner has a weight-average particle size of 1–6 μm, and the magnetic carrier has a number-average particle size of 5–35 μm.

51. The image forming method according to claim 50, wherein the magnetic carrier comprises core particles containing 50–95 wt. % of a ferromagnetic metal oxide, and the magnetic carrier has a magnetization at 1 kilo-oersted of 100–150 emu/cm$^3$.

52. The image forming method according to claim 40, wherein the non-magnetic toner has a weight-average particle size of 3–8 μm, and the magnetic carrier has a number-average particle size of 35–80 μm.

53. The image forming method according to claim 52, wherein the magnetic carrier comprises core particles containing 30–60 wt. % of a ferromagnetic metal oxide, and the magnetic carrier has a magnetization at 1 kilo-oersted of 30–100 emu/cm$^3$.

54. The image forming method according to claim 49, wherein the ferromagnetic comprises magnetite.

55. The image forming method according to claim 49, wherein the higher-resistivity metal oxide comprises hematite.

56. The image forming method according to claim 49, wherein the ferromagnetic comprises magnetite, and the higher-resistivity metal oxide comprises hematite.

57. The image forming method according to claim 40, wherein the developer further comprises inorganic fine powder having an average particle size of at most 0.2 μm as an external additive to the toner.

58. The image forming method according to claim 40, wherein the developer further comprises organic fine powder having an average particle size of at most 0.2 μm as an external additive to the toner.

59. The image forming method according to claim 40, wherein the developer further comprises inorganic fine powder having an average particle size of at most 0.2 μm and organic fine powder having an average particle size of at most 0.2 μm as external additives to the toner.

60. The image forming method according to claim 58 to 59, wherein the organic fine powder comprises fine particles of a resin.

* * * * *

UNITED STATES PATENT AND TRADEMARK OFFICE

CERTIFICATE OF CORRECTION

PATENT NO. : 5,712,069

DATED : January 27, 1998

INVENTOR(S) : YOSHINOBU BABA ET AL.

It is certified that error appears in the above-identified patent and that said Letters Patent is hereby corrected as shown below:

On the title page, item :

[56] OTHER PUBLICATIONS

Insert --OTHER PUBLICATIONS
Patent Abstracts of Japan, Vol. 14, No. 88 (P-1508) [4031] 2/1990 for JP-1-297657.
Patent Abstracts of Japan, Vol. 15, No. 75 (P-1169) 2/1991 for JP-2-294664.
Patent Abstracts of Japan, Vol. 17, No. 129 (P-1503) 3/1993 for JP-4-309965.--.

[57] ABSTRACT

Line 14, "emu/g" should read --emu/$cm^3$--.

COLUMN 1

Line 18, "fixed" should read --fixed,--.
Line 19, ", e.g.," should read --e.g.,--.

COLUMN 2

Line 41, "various" should read --while various--.

COLUMN 3

Line 28, "emu/g" should read --emu/$cm^3$--.

COLUMN 4

Line 20, "emu/g" should read --emu/$cm^3$--.

UNITED STATES PATENT AND TRADEMARK OFFICE

CERTIFICATE OF CORRECTION

PATENT NO. : 5,712,069

DATED : January 27, 1998

INVENTOR(S) : YOSHINOBU BABA ET AL.

It is certified that error appears in the above-identified patent and that said Letters Patent is hereby corrected as shown below:

COLUMN 5

Line 2, "prevent" should read --to prevent--.

COLUMN 10

Line 53, "resin urea-" should read --resin, urea---.
Line 58, "It also" should read --it is also--.
Line 62, "through" should be deleted.

COLUMN 11

Line 42, "[emu/" should read --(emu/--.

COLUMN 15

Line 29, "and" should read --, and--.

COLUMN 16

Line 11, "to high" should read --to cause high--.
Line 49, "alone" should read --along--.
Line 54, "about" should be deleted.
Line 57, "conveyer" should read --conveyor--.
Line 59, "conveyer" should read --conveyor--.

UNITED STATES PATENT AND TRADEMARK OFFICE

CERTIFICATE OF CORRECTION

PATENT NO. : 5,712,069

DATED : January 27, 1998

INVENTOR(S) : YOSHINOBU BABA ET AL.

It is certified that error appears in the above-identified patent and that said Letters Patent is hereby corrected as shown below:

COLUMN 17

Line 14, "four-types" should read --four types--.
Line 18, "four-types" should read --four types--.

COLUMN 18

Line 3, "conveyer" should read --conveyor--.
Line 55, "state. The" should read --state, the--.

COLUMN 19

Line 6, "as the" should read --is the--.

COLUMN 20

Line 19, "$\beta$-" should read --$\alpha$---.

COLUMN 24

Exhibit 1, "$O_2$" should read --$O_3$--.

COLUMN 27

Line 53, "melt-knead" should read --melt-kneaded--.

COLUMN 28

Line 51, "respect" should read --respect to--.

UNITED STATES PATENT AND TRADEMARK OFFICE

CERTIFICATE OF CORRECTION

PATENT NO. : 5,712,069

DATED : January 27, 1998

INVENTOR(S) : YOSHINOBU BABA ET AL.

It is certified that error appears in the above-identified patent and that said Letters Patent is hereby corrected as shown below:

COLUMN 29

Line 13, "&" should read --A--.

COLUMN 30

Line 29, "toughening" should read --roughening--.

COLUMN 32

Table 2, ": Fair" should read --Δ: fair--; and "X:" (first occurrence) should read --Δx:--.

Signed and Sealed this

Twenty-ninth Day of December, 1998

*Attest:*

Bruce Lehman

BRUCE LEHMAN

*Attesting Officer*

*Commissioner of Patents and Trademarks*